US008389194B2

(12) United States Patent
Akazawa et al.

(10) Patent No.: US 8,389,194 B2
(45) Date of Patent: Mar. 5, 2013

(54) METHOD OF MANUFACTURING TONER, TONER OBTAINED BY METHOD THEREOF, ONE-COMPONENT DEVELOPER, TWO-COMPONENT DEVELOPER, DEVELOPING DEVICE AND IMAGE FORMING APPARATUS

(75) Inventors: Yoshiaki Akazawa, Osaka (JP); Yoshitaka Kawase, Osaka (JP); Yoritaka Tsubaki, Osaka (JP); Yoshinori Mutoh, Osaka (JP); Keiichi Kikawa, Osaka (JP); Takashi Hara, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 463 days.

(21) Appl. No.: 12/731,396

(22) Filed: Mar. 25, 2010

(65) Prior Publication Data

US 2010/0248124 A1 Sep. 30, 2010

(30) Foreign Application Priority Data

Mar. 26, 2009 (JP) ..... 2009-077766

(51) Int. Cl.
*G03G 5/00* (2006.01)

(52) U.S. Cl. ..... 430/137.11; 430/110.2; 399/252

(58) Field of Classification Search ..... 430/137.11, 430/110.2; 399/252
See application file for complete search history.

(56) References Cited

U.S. PATENT DOCUMENTS

| | | | | |
|---|---|---|---|---|
| 4,915,987 | A | 4/1990 | Nara et al. | |
| 5,296,266 | A | 3/1994 | Kunugi et al. | |
| 8,236,473 | B2 * | 8/2012 | Kawase et al. | 430/137.1 |
| 2005/0282078 | A1 | 12/2005 | Kataoka et al. | |
| 2008/0166156 | A1 * | 7/2008 | Kawase | 399/222 |

FOREIGN PATENT DOCUMENTS

| | | | |
|---|---|---|---|
| CN | 1710492 | A | 12/2005 |
| JP | 64-042660 | | 2/1989 |
| JP | 1-306859 | A | 12/1989 |
| JP | 03-293676 | | 12/1991 |
| JP | 04-182665 | | 6/1992 |
| JP | 04-182669 | | 6/1992 |

(Continued)

OTHER PUBLICATIONS

U.S. Appl. No. 12/730,422, filed Mar. 24, 2010, entitled "Method of Manufacturing Toner, Toner Obtained by Method Thereof, One-Component Developer, Two-Component Developer, Developing Device and Image Forming Apparatus".

(Continued)

*Primary Examiner* — Mark A Chapman
(74) *Attorney, Agent, or Firm* — Nixon & Vanderhye PC

(57) ABSTRACT

A toner manufacturing method, a toner obtained by the method, a one-component developer, a two-component developer, a developing device and an image forming apparatus are provided. By using a toner manufacturing apparatus including a powder passage, a spraying section for spraying a predetermined substance in the powder passage and a rotary stirring section, provided in the powder passage, and stirring particles in the powder passage to apply impact force to the particles so that the particles are fluidized in the powder passage, performed are a stirring step S3 of fluidizing toner core particles with fine inorganic particles adhering to the surfaces thereof and fine resin particles in the powder passage as the powder by the rotary stirring section, and a spraying step S5 of spraying a volatile liquid which softens fine resin particles as a predetermined substance by the spraying section.

13 Claims, 7 Drawing Sheets

FOREIGN PATENT DOCUMENTS

| | | | |
|---|---|---|---|
| JP | 04-211269 | | 8/1992 |
| JP | 05-10971 | | 2/1993 |
| JP | 07-261447 | | 10/1995 |
| JP | 2004-082005 | A | 3/2004 |
| JP | 2004-294468 | A | 10/2004 |
| JP | 2008-191639 | A | 8/2008 |
| JP | 2008-281625 | A | 11/2008 |

OTHER PUBLICATIONS

Notice of Allowance mailed Apr. 19, 2012 in U.S. Appl. No. 12/605,686.

Restriction Requirement mailed Mar. 12, 2012 in U.S. Appl. No. 12/605,686.

Office Action mailed Aug. 30, 2012 in U.S. Appl. No. 12/730,422.

* cited by examiner

METHOD OF MANUFACTURING TONER, TONER OBTAINED BY METHOD THEREOF, ONE-COMPONENT DEVELOPER, TWO-COMPONENT DEVELOPER, DEVELOPING DEVICE AND IMAGE FORMING APPARATUS

CROSS-REFERENCE TO RELATED APPLICATION

This application claims priority to Japanese Patent Application No. 2009-077766, which was filed on Mar. 26, 2009, the contents of which are incorporated herein by reference in its entirety.

BACKGROUND OF THE INVENTION

1. Field of the Invention

The present invention relates to a method of manufacturing a toner according to a toner used for electrophotography, a toner obtained by a method thereof, a one-component developer, a two-component developer, a developing device and an image forming apparatus.

2. Description of the Related Art

An image forming apparatus employing an electrophotography farms an image by a charging step, an exposure step, a developing step, a transfer step, and a fixing step. At the charging step, the surface of a photoreceptor is uniformly charged by a charging section. At the exposure step, a laser beam is irradiated by the exposure section to the charged photoreceptor surface and an electrostatic latent image is formed. At the developing step, the electrostatic latent image on the photoreceptor is developed by a developing section and a toner image is formed on the photoreceptor. At the transfer step, the toner image on the photoreceptor is transferred onto a recording medium by a transfer section. At the fixing step, the toner image transferred onto the recording medium is heated by a fixing section and the toner image is fixed on the recording medium.

To realize energy saving of the image forming apparatus at the above fixing step, development of a low temperature fixation toner in which a binder resin whose softening point is low is used and which is fixable at a relatively low temperature, is in process. However, by using the binder resin whose softening point is low, preservation stability of a toner decreases and a toner aggregation may be generated.

Therefore, in order to enhance the preservation stability of the toner, a surface modification treatment for coating the surfaces of toner core particles with a coating material has been performed. By coating the toner core particles and manufacturing a toner, the toner aggregation is able to be suppressed.

Japanese Examined Patent Publication JP-B2 5-10971 (1993) discloses as a method of the surface modification treatment, a method that a mechanical stirring force is applied to powder particles by a rotary stirring section such as a screw, a blade, or a rotor to fluidize the powder particles in a powder flowing passage, a liquid is sprayed from a spray nozzle to the powder particles in a fluid state, and the surfaces of the powder particles are coated by a coating material contained in the spray liquid. According to the method described in JP-B2 5-10971, adhesiveness between the coating material and the powder particles is able to be improved and time required for the surface modification treatment is able to be shortened.

Further, Japanese Unexamined Patent Publication JP-A 3-293676 (1991) discloses a method of manufacturing a microcapsule in which resin particles and fine inorganic particles adhere to the surfaces of inner core particles and the resin particles are dissolved with a solvent to form a coating layer on the surface of the inner core particle. According to the method described in JP-A 3-293676, after forming the coating layer on the surface of the inner core particle with the treatment using the solvent, a microcapsule is obtained by drying and removing.

Since, however, a coating material in a spray liquid is in a state of aggregation by a method described in JP-B2 5-10971, there is a problem that an aggregation thereof adheres to the surface of a powder particle without disintegration so that thickness of a coating material layer formed on the surface of the powder particle is non-uniform. Additionally, since a large quantity of a dispersant is contained in the spray liquid so as to disperse the coating material, there is also a problem that a dispersant remains inside and on the surface of the coating material layer.

Further, there is also a problem that since the spray liquid on a particle of a coating material detaches or evaporates easily, the coating material layer is not sufficiently formed. On the other hand, when an amount of the spray liquid is increased to solve the problem, the spray liquid is retained in the manufacturing apparatus so that the powder particle adheres to a wall surface inside the manufacturing apparatus, and the yield is lowered.

Further according to the method described in JP-A 3-293676, the solvent which has dissolved the resin particles becomes hard to vaporize. Thereby, the aggregate of the inner core particles are generated or the inner core particles adhere to an inner wall surface of the manufacturing apparatus. As a result, the yield is lowered. Moreover, some type of solvent may even dissolve the inner core particles. When the inner core particles are dissolved, an additive such as wax inside the inner core particles is fixed or exposed on the surfaces of the inner core particles, and the preservability or the like of the microcapsule is lowered.

SUMMARY OF THE INVENTION

The invention is to solve the problems described above, and its object is to provide a method of manufacturing a toner in which a fine resin particle layer having a uniform thickness is formed on the surface of a toner core particle, and adhesion of toner core particles and fine resin particles to a wall surface inside a toner manufacturing apparatus is suppressed, a toner obtained by the method, a one-component developer, a two-component developer, a developing device and an image forming apparatus.

The invention provides a toner manufacturing method of manufacturing a toner using a toner manufacturing apparatus comprising a powder passage in which a powder is flowable, a spraying section for spraying a predetermined substance in the powder passage and a rotary stirring section, provided in the powder passage, and stirring particles in the powder passage to apply impact force to the particles so that the particles are fluidized in the powder passage, the toner manufacturing method comprising:

a stirring step of fluidizing toner core particles with fine inorganic particles adhering to the surfaces thereof and fine resin particles in the powder passage as the powder by the rotary stirring section; and a spraying step of spraying a volatile liquid which softens the fine resin particles as the predetermined substance by the spraying section.

According to the invention, in toner core particles with fine inorganic particles adhering to the surfaces thereof, secondary aggregate of fine resin particles are hard to adhere at the stirring step, compared to toner core particles in which fine inorganic particles do not adhere to the surfaces thereof, and therefore fine resin particles adhere uniformly to each part of the surfaces of the toner core particles. Additionally, the volatile liquid sprayed at the spraying step is absorptively retained by the fine inorganic particles adhering to the surface of the toner core particle so that it is possible to suppress an evaporation speed of the volatile liquid which adhere to the surfaces of the toner core particles. Accordingly, it is possible to soften the fine resin particles which adhere to the surface of the toner core particle by a relatively small amount of spray of the volatile liquid. Consequently, it is possible to form, the surface of the toner core particle, a fine resin particle layer whose thickness is uniform, while suppressing the adhesion of the toner core particles and the fine resin particles to the wall surface inside the toner manufacturing apparatus.

Further, in the invention, it is preferable that the fine inorganic particles have a number average particle size of 12 nm or more and 40 nm or less.

According to the invention, since a number average particle size of the fine inorganic particles adhering to the toner core particle is preferable, it is possible to further suppress fixing of secondary aggregate of fine resin particles on the surface of the toner core particle. Additionally, the toner core particles with fine inorganic particles adhering to the surfaces thereof are able to absorptively retain more volatile liquids. Accordingly, it is possible to form, on the surface of a toner core particle, a fine resin particle layer whose thickness is more uniform, while suppressing adhesion of toner core particles and fine resin particles to the wall surface inside the toner manufacturing apparatus.

Further, in the invention, it is preferable that the fine resin particle is a fine resin particle in which fine inorganic particles having a number average particle size of 12 nm or more and 40 nm or less adhere to the surface thereof.

According to the invention, fine resin particles, since fine inorganic particles adhere to the surfaces thereof, are hard to adhere to the surface of toner core particle in a state of secondary aggregate. Additionally, the fine resin particles that are disintegrated from the state of secondary aggregate adhere to the surfaces of the fine inorganic particles so that reaggregate is suppressed. Therefore, the fine resin particles adhere uniformly to each part of the surface of the toner core particle. Moreover, the volatile liquid sprayed at the spraying step is absorptively retained by the fine inorganic particles adhering to the surfaces of the fine resin particles so that an evaporation speed of the volatile liquid adhering to the surfaces of the fine resin particles is suppressed. Therefore, a relatively small amount of spray of the volatile liquid is able to soften the fine resin particles adhering to the surface of the toner core particle. Consequently, it is possible to form, on the surface of toner core particle, a fine resin particle layer whose thickness is more uniform while suppressing adhesion of the toner core particles and the fine resin particles to the wall surface inside the toner manufacturing apparatus.

Further, in the invention, it is preferable that the toner core particles are toner core particles in which the fine inorganic particles adhere to the surfaces of the toner core particles so that an additive ratio by weight which is percentage of a total weight of the fine inorganic particles adhering to the surface of the toner core particle to the weight of the toner core particle is 0.2% or more and 5% or less.

According to the invention, since, to the weight of the toner core particle, the total weight of the fine inorganic particles adhering to the surface of the toner core particle is preferable, it is possible to form a fine resin particle layer with sufficient strength on the surface of the toner core particle while suppressing sufficiently an evaporation speed of the volatile liquid.

Further, in the invention, it is preferable that the fine inorganic particle contains at least one of silica, titanium oxide and metatitanic acid.

According to the invention, since silica, titanium oxide and metatitanic acid are hard to aggregate on the surface of the toner core particle or the surface of the fine resin particle, the amount of a volatile liquid that is absorptively retained by the fine inorganic particles is uniform in each part of the surface. Therefore, it is possible to form a fine resin particle layer whose thickness is more uniform on the surface of the toner core particle.

Further, in the invention, it is preferable that the fine inorganic particle contains at least one of silica whose surface is treated with hexamethyldisilazane, and titanium oxide and metatitanic acid whose surfaces are treated with trimethylchlorosilane.

According to the invention, since the fine inorganic particles adhering to the surface of the toner core particle or the surface of the fine resin particle are further hard to aggregate by surface treatment, which causes uniform dispersion to the surfaces of the toner core particles or the surfaces of the fine resin particles, the amount of the volatile liquid that is absorptively retained by the fine inorganic particles becomes more uniform in each part of the surface. Consequently, it is possible to form a fine resin particle layer whose thickness is more uniform on the surface of the toner core particle.

Further, the invention provides a toner obtained by the toner manufacturing method mentioned above.

According to the invention, the toner according to the invention is a toner that a fine resin particle layer whose thickness is uniform and exuding of an additive is suppressed. Accordingly, it is possible to form an image with high definition and high image quality without unevenness in the concentration for a long time.

Further, the invention provides a one-component developer comprising the toner mentioned above.

According to the invention, by containing the toner, a one-component developer capable of forming an image with high definition and high image quality without unevenness in density for a long time is able to be realized.

Further, the invention provides a two-component developer including the toner mentioned and a carrier.

According to the invention, by including the toner mentioned above and a carrier, it is possible to realize a two-component developer capable of stably forming an image that has high definition and high image quality without unevenness in density for a long time.

Further, the invention provides a developing device that performs a development by using the one-component developer or two-component developer mentioned above.

According to the invention, by performing a development using the one-component developer or two-component developer mentioned above, it is possible to realize a developing device capable of stably forming an image that has high definition and high image quality without unevenness in the concentration for a long time.

Further, the invention provides an image forming apparatus comprising the developing device mentioned above.

According to the invention, by including the developing device, it is possible to realize an image forming apparatus capable of stably forming an image that has high definition and high image quality without unevenness in the concentration for a long time.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
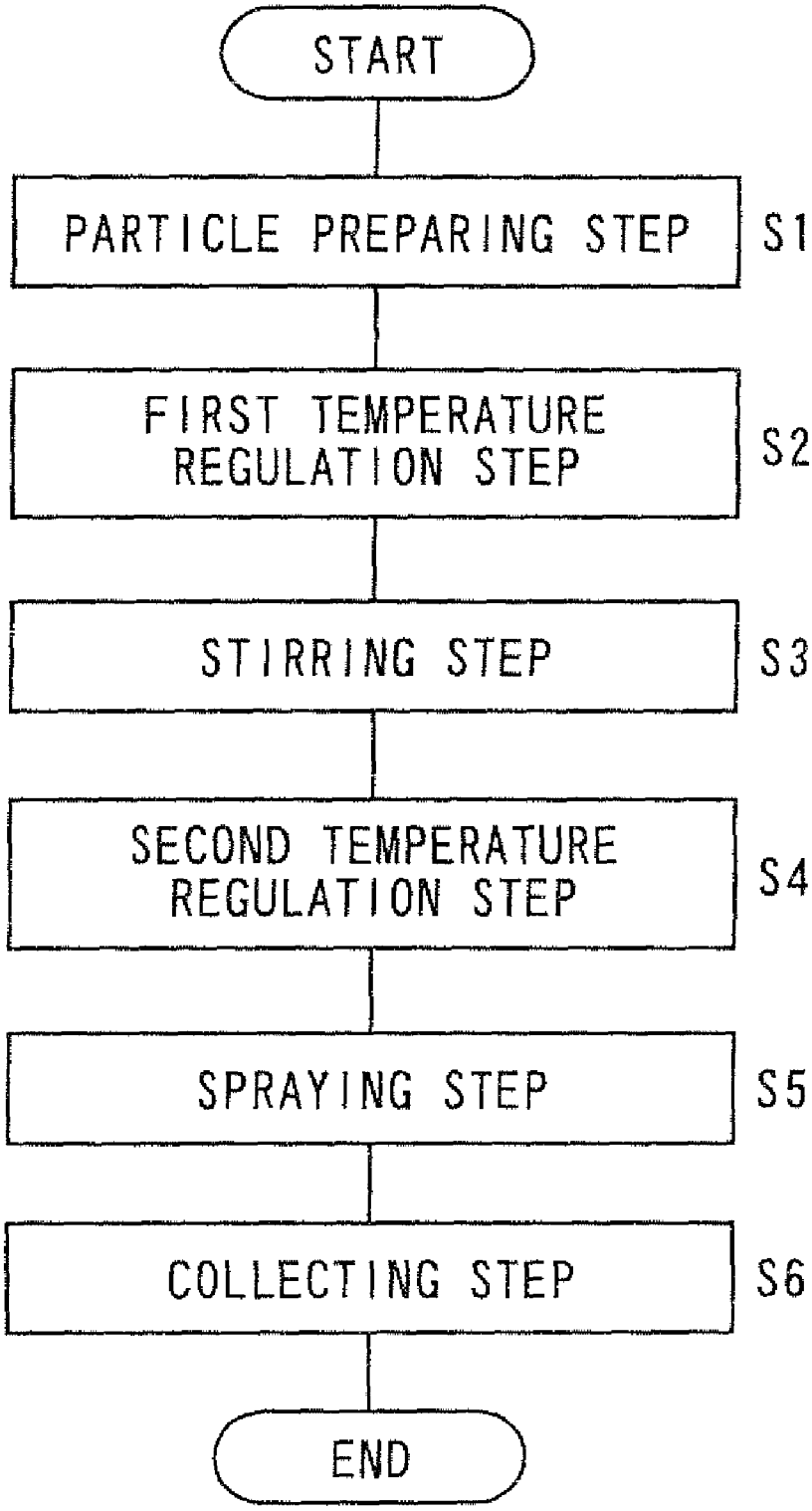
FIG. 1 is a process drawing showing a toner manufacturing process.

Now referring to the drawings, preferred embodiments of the invention are described below.

1. Toner Manufacturing Method

A toner manufacturing method according to the invention includes, by using a specific toner manufacturing apparatus, a stirring step of fluidizing toner core particles with fine inorganic particles adhering to surfaces thereof and fine resin particles in a powder passage by a rotary stirring section and a spraying step of spraying a volatile liquid which causes the softening of fine resin particles by a spraying section. The specific toner manufacturing apparatus is a toner manufacturing apparatus comprising a powder passage in which a powder is flowable, a spraying section for spraying a predetermined substance in the powder passage and a rotary stirring section, provided in the powder passage, and stirring particles in the powder passage to apply impact force to the particles so that the particles are fluidized in the powder passage.

Description will be given below for a toner manufacturing process according to an embodiment of the toner manufacturing method of the invention. FIG. 1 is a process drawing showing a toner manufacturing process. The toner manufacturing process includes a particle preparing step S1, a first temperature regulation step S2, a stirring step S3, a second temperature regulation step S4, a spraying step S0 and a collecting step S6. At the particle preparing step S1, toner core particles and fine resin particles are prepared respectively. At the first temperature regulation step S2, a temperature in a toner manufacturing apparatus 201 shown in FIG. 2 to be described later. At the stirring step S3, the toner core particles and the fine resin particles in which fine inorganic particles adhere to the surfaces thereof are fluidized in the toner manufacturing apparatus 201 to adhere the fine resin particles to the surfaces of the toner core particles and collect the toner core particles. At the second temperature regulation step S4, a temperature in the toner manufacturing apparatus 201 is regulated. At the spraying step S5, the toner core particles collected at the stirring step S3 are inputted and fluidized in the toner manufacturing apparatus 201, a volatile liquid which softens fine resin particles is sprayed in the toner manufacturing apparatus 201, and thereby the fine resin particle adhering to the toner core particle is softened to form a fine resin particle layer on the surface of the toner core particle. At the collecting step S6, toner core particles (toner particles) in which fine resin particle layers are formed on the surfaces thereof are collected. Description will be given in detail below for each of the steps S1 to S6.

(1) Particle Preparing Step S1

At the particle preparing step S1, toner core particles and fine resin particles are respectively prepared.

(i) Preparation of Toner Core Particles

The toner core particles are particles each containing a binder resin and a colorant and can be obtained with a known preparation method. A preparation method thereof is not particularly limited. Examples of the method for preparing toner core particles include dry methods such as pulverization methods, and wet methods such as suspension polymerization methods, emulsion aggregation methods, dispersion polymerization methods, dissolution suspension methods and melting emulsion methods. The preparation of toner core particles using a pulverization method will be described below.

(Raw Materials of Toner Core Particles)

The binder resin is not particularly limited and any known binder resin used for a black toner or a color toner is usable. Examples thereof include styrene resin such as polystyrene and styrene-acrylic acid ester copolymer resin, acrylic resin such as polymethylmethacrylate, polyolefin resin such as polyethylene, polyester, polyurethane, and epoxy resin. Further, resin obtained by polymerization reaction induced by mixing a monomer mixture material and a release agent may be used. The binder resins may be used each alone, or two or more of them may be used in combination.

It is preferred that the binder resin has a glass transition point of 30° C. or higher and 80° C. or lower. The binder resin having a glass transition point lower than 30° C. easily causes the blocking that the toner thermally aggregates inside the image forming apparatus, which decreases preservation stability of the toner. The binder resin having a glass transition point exceeding 80° C. lowers the fixing property of the toner onto a recording medium, which causes a fixing failure.

Among the above-described binder resins, polyester is excellent in transparency and capable of providing the aggregated particles with suitable powder flowability, low-temperature fixing properties, and secondary color reproducibility, thus being appropriate as a binder resin for a color toner. As polyester, heretofore known ingredients can be used, including a polycondensation of polybasic acid and polyhydric alcohol. As polybasic acid, those known as monomers for polyester can be used, including aromatic carboxylic acids such as terephthalic acid, isophthalic acid, acid phthalic anhydride, trimellitic anhydride, pyromellitic acid, and naphthalene dicarboxylic acid; aliphatic carboxylic acids such as maleic acid anhydride, fumaric acid, succinic acid, alkenyl succinic anhydride, and adipic acid; and a methyl-esterified compound of these polybasic acids. The polybasic acids may be used each alone, or two or more of them may be used in combination. For polyvalent alcohol, substances known as monomers for polyester can be used including, for example: aliphatic polyvalent alcohols such as ethylene glycol, propylene glycol, butenediol, hexanediol, neopentyl glycol, and glycerin; alicyclic polyvalent alcohols such as cyclohexanediol, cyclohexanedimethanol, and hydrogenated bisphenol A; and aromatic diols such as ethylene oxide adduct of bisphenol A and propylene oxide adduct of bisphenol A. The polyvalent alcohols may be used each alone, or two or more of them may be used in combination.

The polybasic acid and the polyvalent alcohol can undergo polycondensation reaction by a known method. Polycondensation reaction is undergone, for example, by making the polybasic acid and the polyvalent alcohol bring into contact with each other in the presence or absence of the organic solvent and in the presence of polycondensation catalyst. The polycondensation reaction ends when an acid number, a softening point, etc. of the polyester to be produced reach predetermined values. The polyester is obtained by such a polycondensation reaction.

Further, when the methyl-esterified compound of the polybasic acid is used as part of the polybasic acid, demethanol polycondensation reaction is caused. In the polycondensation reaction, a compounding ratio, a reaction rate, etc. of the polybasic acid and the polyvalent alcohol are appropriately modified, thereby being capable of, for example, adjusting a content of a carboxyl end group in the polyester and thus allowing for denaturation of the polyester. Further, when trimellitic anhydride is used as polybasic acid, a carboxyl group can simply introduce to a main chain of the polyester and thus the denatured polyester can be obtained. Note that polyester self-dispersible having self-dispersibility in water may also be polyester has at least one of a main chain and side chain bonded to a hydrophilic radical such as a carboxyl group or a sulfonate group. Further, polyester may be grafted with acrylic resin.

As the colorant, it is possible to use an organic dye, an organic pigment, an inorganic dye, an inorganic pigment or the like which is customarily used in the electrophotographic field.

Examples of black colorant include carbon black, copper oxide, manganese dioxide, aniline black, activated carbon, non-magnetic ferrite, magnetic ferrite, and magnetite.

Examples of yellow colorant include chrome yellow, zinc yellow, cadmium yellow, yellow iron oxide, mineral fast yellow, nickel titanium yellow, navel yellow, naphthol yellow S, hanza yellow G, hanza yellow 10G, benzidine yellow G, benzidine yellow GR, quinoline yellow lake, permanent yellow NCG, tartrazine lake, C.I. pigment yellow 12, C.I. pigment yellow 13, C.I. pigment yellow 14, C.I. pigment yellow 15, C.I. pigment yellow 17, C.I. pigment yellow 93, C.I. pigment yellow 94, C.I. pigment yellow 138, C.I. pigment yellow 180, and C.I. pigment yellow 185.

Examples of orange colorant include red chrome yellow, molybdenum orange, permanent orange GTR, pyrazolone orange, vulcan orange, indanthrene brilliant orange RK, benzidine orange G, indanthrene brilliant orange GK, C.I. pigment orange 31, and C.I. pigment orange 43.

Examples of red colorant include red iron oxide, cadmium red, red lead, mercury sulfide, cadmium, permanent red 4R, lysol red, pyrazolone red, watching red, calcium salt, lake red C, lake red D, brilliant carmine 6B, eosin lake, rhodamine lake B, alizarin lake, brilliant carmine 3E, C.I. pigment red 2, C.I. pigment red 3, C.I. pigment red 5, C.I. pigment red 6, C.I. pigment red 7, C.I. pigment red 15, C.I. pigment red 16, C.I. pigment red 48:1, C.I. pigment red 53:1, C.I. pigment red 57:1, C.I. pigment red 122, C.I. pigment red 123, C.I. pigment red 139, C.I. pigment red 144, C.I. pigment red 149, C.I. pigment red 166, C.I. pigment red 177, C.I. pigment red 178, and C.I. pigment red 222.

Examples of purple colorant include manganese purple, fast violet B, and methyl violet lake.

Examples of blue colorant include Prussian blue, cobalt blue, alkali blue lake, Victoria blue lake, phthalocyanine blue, non-metal phthalocyanine blue, phthalocyanine blue-partial chlorination product, fast sky blue, indanthrene blue BC, C.I. pigment blue 15, C.I. pigment blue 15:2, C.I. pigment blue 15:3, C.I. pigment blue 16, and C.I. pigment blue 60.

Examples of green colorant include chromium green, chromium oxide, pigment green B, malachite green lake, final yellow green C, and C.I. pigment green 7.

Examples of white colorant include those compounds such as zinc oxide, titanium oxide, antimony white, and zinc sulfide.

The colorants may be used each alone, or two or more of the colorants of different colors may be used in combination. Further, two or more of the colorants with the same color may be used in combination. A usage of the colorant is not limited to a particular amount, and preferably 5 parts by weight to 20 parts by weight, and more preferably 5 parts by weight to 10 parts by weight based on 100 parts by weight of the binder resin.

Further, the toner core particles may contain a charge control agent as an additive. For the charge control agent, charge control agents commonly used in this field for controlling a positive charge or a negative charge are usable. Examples of the charge control agent for controlling a positive charge include a basic dye, a quaternary ammonium salt, a quaternary phosphonium salt, an aminopyrine, a pyrimidine compound, a polynuclear polyamino compound, an aminosilane, a nigrosine dye, a derivative thereof, a triphenylmethane derivative, a guanidine salt and an amidin salt. Examples of the charge control agent for controlling a negative charge include an oil-soluble dye such as an oil black and a spirone black, a metal-containing azo compound, an azo complex dye, a naphthene acid metal salt, a metal complex or metal salt (the metal is a chrome, a zinc, a zirconium or the like) of a salicylic acid or of a derivative thereof, a boron compound, a fatty acid soap, a long-chain alkylcarboxylic acid salt and a resin acid soap. The charge control agents may be used each alone, or optionally two or more of them may be used in combination. Although the amount of the charge control agent to be used is not particularly limited and can be properly selected from a wide range, 0.5 part by weight and 3 parts by weight is preferably used based on 100 parts by weight of the binder resin.

Further, the toner core particles may contain a release agent as an additive. As the release agent, it is possible to use ingredients which are customarily used in the relevant field, including, for example, petroleum wax such as paraffin wax and derivatives thereof, and microcrystalline wax and derivatives thereof; hydrocarbon-based synthetic wax such as Fischer-Tropsch wax and derivatives thereof, polyolefin wax (e.g. polyethylene wax and polypropylene wax) and derivatives thereof, low-molecular-weight polypropylene wax and derivatives thereof, and polyolefinic polymer wax (low-molecular-weight polyethylene wax, etc.) and derivatives thereof; vegetable wax such as carnauba wax and derivatives thereof, rice wax and derivatives thereof, candelilia wax and derivatives thereof, and haze wax; animal wax such as bees wax and spermaceti wax; fat and oil-based synthetic wax such as fatty acid amides and phenolic fatty acid esters; long-chain carboxylic acids and derivatives thereof; long-chain alcohols and derivatives thereof; silicone polymers; and higher fatty acids. Note that examples of the derivatives include oxides, block copolymers of a vinylic monomer and wax, and graft-modified derivatives of a vinylic monomer and wax. A usage of the wax may be appropriately selected from a wide range without particularly limitation, and preferably 0.2 part by weight to 20 parts by weight, more preferably 0.5 part by weight to 10 parts by weight, and particularly preferably 1.0 part by weight to 8.0 parts by weight based on 100 parts by weight of the binder resin.

(Method for Preparing Toner Core Particles)

Preparation of toner core particles by a pulverization method, toner core particles containing a binder resin, a colorant and other additives are dry-mixed by a mixer, and thereafter melt-kneaded by a kneading machine. The kneaded material obtained by melt-kneading is cooled and solidified, and then the solidified material is pulverized by a pulverizing machine. Subsequently, the toner core particles are optionally obtained by conducting adjustment of a particle size such as classification.

In dry-mixing, a masterbatch containing colorants, a composite particle containing additives may be used. The composite particle is capable of being manufactured, for example, by mixing two or more of the additives, an appropriate amount of water, lower alcohol and the like, and granulating the mixture by a general granulating machine such as a high-speed mill, followed by drying. By using the masterbatch and the composite particle, colorants and additives are able to be uniformly dispersed into a kneaded product.

Usable mixers include heretofore known mixers including, for example, Henschel-type mixing devices such as HENSCHEL MIXER (trade name) manufactured by Mitsui Mining Co., Ltd., SUPERMIXER (trade name) manufactured by Kawata MFG Co., Ltd., and MECHANOMILL (trade name) manufactured by Okada Seiko Co., Ltd., ANGMILL (trade name) manufactured by Hosokawa Micron Corporation, HYBRIDIZATION SYSTEM (trade name) manufactured by Nara Machinery Co., Ltd., and COSMOSYSTEM (trade name) manufactured by Kawasaki Heavy Industries, Ltd.

Usable kneaders include heretofore known kneaders including, for example, commonly-used kneaders such as a twin-screw extruder, a three roll mill, and a laboplast mill. Specific examples of such kneaders include single or twin screw extruders such as TEM-100B (trade name) manufactured by Toshiba Machine Co., Ltd., PCM-65/87 (trade name) manufactured by Ikegai, Ltd., and PCM-30 (trade name) manufactured by Ikegai, Ltd., and open roll-type kneading machines such as KNEADEX (trade name) manufactured by Mitsui Mining Co., Ltd. Among them, the open roll-type kneading machines are preferable.

Usable pulverizing machines include heretofore known pulverizing machines including, for example, a jet pulverizing machine that performs pulverization using ultrasonic jet air stream, and an impact pulverizing machine that performs pulverization by guiding a solidified material to a space formed between a rotor that is rotated at high speed and a stator liner).

For the classification, a known classifying machine removing excessively pulverized toner core particles by classification with a centrifugal force or classification with a wind force is usable and an example thereof includes a revolving type wind-force classifying machine (rotary type wind-force classifying machine).

(Toner Core Particle)

The toner core particles preferably have a volume average particle size of 4 μm or more and 8 μm or less. In a case where the volume average particle size of the toner core particles is 4 μm or more and 8 μm or less, it is possible to stably form a high-definition image for a long time. In a case where the volume average particle size of the toner core particles is less than 4 μm, the particle size of the toner core particles becomes too small and high charging and low fluidity of the toner are likely to occur. When the high charging and the low fluidity of the toner occur, a toner is unable to be stably supplied to a photoreceptor and a background fog and image density decrease are likely to occur. In a case where the volume average particle size of the toner core particles exceeds 8 μm, the particle size of the toner particles becomes too large and the thickness of a formed image is increased so that an image with remarkable granularity is likely to be generated. When the particle size of the toner particles becomes too large, the high-definition image is not obtainable. In addition, as the particle size of the toner core particles becomes too large, a specific surface area is reduced, resulting in decrease in a charge amount of the toner. When the charge amount of the toner is decreased, the toner is not stably supplied to the photoreceptor and pollution inside the apparatus due to toner scattering is likely to occur.

Moreover, in the case where the volume average particle size of the toner core particles is 4 μm or more and 8 μm or less, it is possible to reduce the particle size of the toner particles, whereby a high image density is obtained even with a small volume amount of toner adhesion, thus causing reducing a toner capacity for a developing device.

(ii) Preparation of Toner Core Particles to Which Fine Inorganic Particles Adhere In the embodiment, toner core particles with the fine inorganic particles adhering to the surfaces thereof are prepared in advance before the stirring step S3. The toner core particles with the fine inorganic particles adhering to the surfaces thereof are ones that the following fine inorganic particles adhere to the aforementioned surfaces of the toner core particles by a commonly known stirring apparatus.

(Fine Inorganic Particles)

As fine inorganic particles, commonly known fine inorganic particles which are used as external additives of a toner are used. It is preferable that the fine inorganic particles contain at least one of silica, titanium oxide and metatitanic acid. Additionally, it is more preferable that the fine inorganic particles include at least one of silica whose surface is treated with hexamethyldisilazane, and titanium oxide and metatitanic acid whose surfaces are treated with trimethylchlorosilane. Moreover, it is preferable that the fine inorganic particles have a number average particle size of 12 nm or more and 40 nm or less.

It is also preferable that two or more types of these fine inorganic particles is used in combination. Thereby, two types of the fine inorganic particles whose charging characteristics are different come to be present in a fine resin particle layer that is formed on the surface of the toner core particle. Therefore, it is possible to make a preferable fine adjustment of a surface resistance value of a toner surface layer to make a preferable fine adjustment of charging characteristics of a toner.

(Preparation Method of Toner Core Particles to Which Fine Inorganic Particles Adhere)

Toner core particles in which fine inorganic particles adhere to the surfaces thereof, for example, by the toner manufacturing apparatus 201, are able to be prepared by stirring toner core particles to which fine inorganic particles do not adhere and fine inorganic particles. When the toner core particles in which the fine inorganic particles adhere to the surfaces thereof are prepared by the toner manufacturing apparatus 201, peripheral speed in an outermost periphery of the rotary stirring section 204 is adjusted to 20 m/sec to 50 m/sec and a temperature in the powder passage 202 is regulated to 20° C. to 50° C., and the fine inorganic particles and toner core particles may be stirred for 10 to 30 seconds.

(Toner Core Particles to Which Fine Inorganic Particles Adhere)

It is preferable that toner core particles in which fine inorganic particles adhere to the surfaces thereof are toner core particles in which the fine inorganic particles adhere to the surfaces of the toner core particles so that an additive ratio by weight which is percentage of the total weight of the fine inorganic particles to the weight of the toner core particles is 0.2% or more and 5% or less.

(iii) Preparation of Fine Resin Particles

Fine resin particles are used as a coating material for coating the surface of toner core particle. By coating the toner core particle with the fine resin particles, it is possible to prevent aggregation of toners due to melting of a low-melting point release agent contained in the toner core particles, for example, during preservation of the toners. Additionally, since the shape of the fine resin particles remain on the surfaces of the toner core particles, it is possible to obtain toner particles excellent in cleaning performance compared to toner particles having a smooth surface.

(Raw Materials of Fine Resin Particles)

For the resin used for raw materials of the fine resin particles, examples thereof include polyester, an acrylic resin, a styrene resin, and a styrene-acrylic copolymer. Among the above resins, the fine resin particles preferably contain at least one of an acrylic resin and a styrene-acrylic copolymer. The acrylic resin and the styrene-acrylic copolymer have many advantages such that the strength is high with light weight, transparency is high, the price is low, and fine resin particles having a uniform particle size are easily obtained.

Although the resin used for the fine resin particles may be the same kind of resin as the binder resin used for the toner core particles or may be a different kind of resin, the different kind of resin is preferably used in view of performing the surface modification of the toner. When the different kind of resin is used as the resin used for the fine resin particles, a softening point of the resin used for the fine resin particles is preferably higher than a softening point of the binder resin used for the toner core particles. By using the resin having such a softening point, it is possible to prevent toners from being fused each other during preservation and to improve preservation stability. Further, the softening point of the resin used for the fine resin particles depends on an image forming apparatus in which the toner is used, but preferably 80° C. or higher and 140° C. or lower. By using the resin having a softening point in such a temperature range, it is possible to obtain the toner having both the preservation stability and the fixing performance.

(Method for Preparing Fine Resin Particles)

The fine resin particles can be obtained, for example, emulsifying and dispersing raw materials of the fine resin particles into fine grains by using a homogenizer or the like machine. Further, the fine resin particles can also be obtained, for example, by polymerizing monomers.

(Fine Resin Particle)

A volume average particle size of the fine resin particles is required to be sufficiently smaller than the volume average particle size of the toner core particles. The volume average particle size of the fine resin particles is preferably 0.05 μm or more and 1 μm or less, and more preferably 0.1 μm or more and 0.5 μm or less. In a case where the volume average particle size of the fine resin particles is 0.05 μm or more and 1 μm or less, a projection of a suitable size is formed on the surface of the toner core particle. With the projections, toner particles are easily caught by cleaning blades at the time of removing the toner, resulting in improvement of the cleaning performance.

(2) Toner Manufacturing Apparatus

Prior to the description for the first temperature regulation step S2, description will be given for the toner manufacturing apparatus 201 used at the first temperature regulation step S2, and the subsequent steps S3 to S6.

Figure 2:
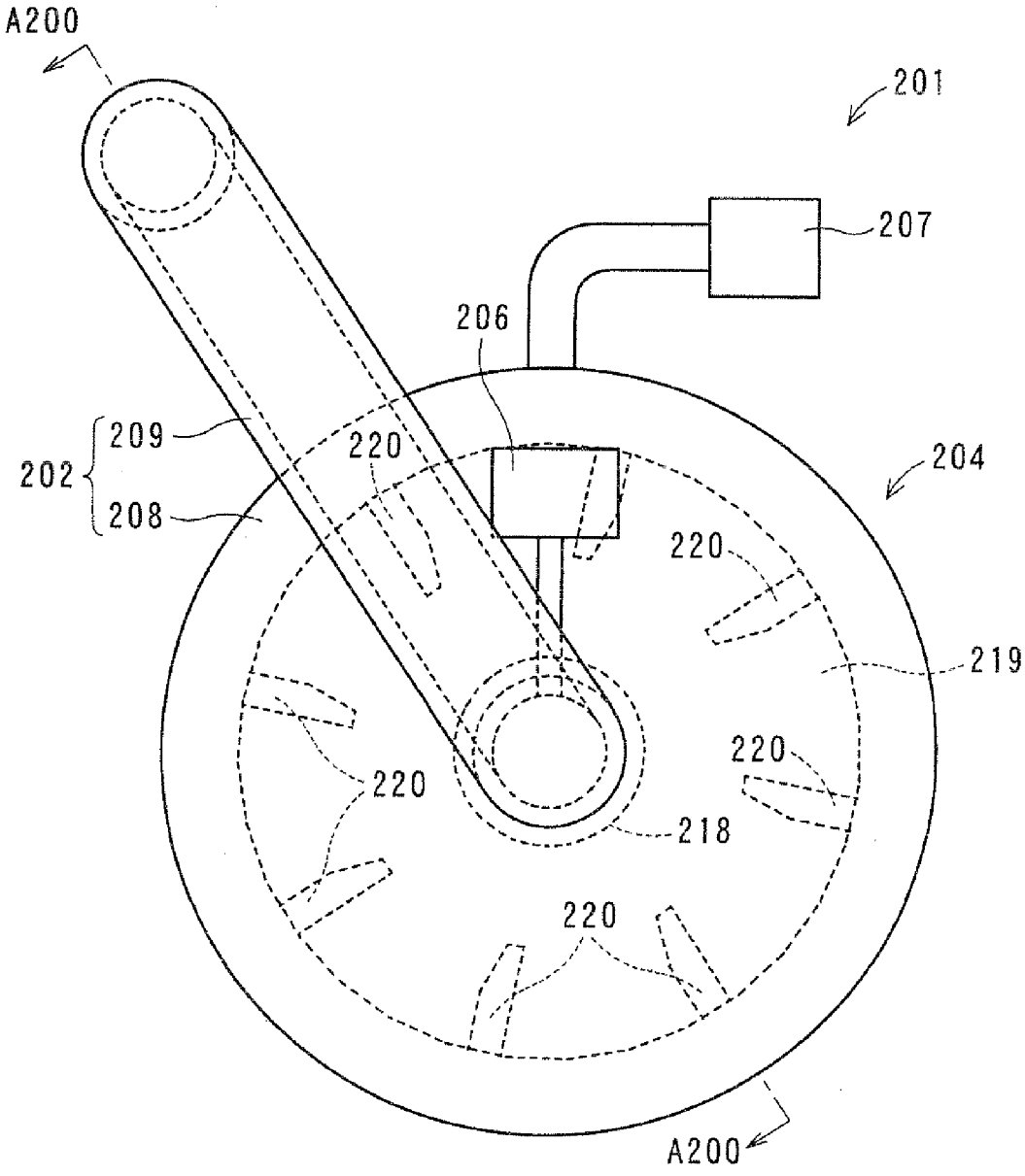
FIG. 2 is a front view of a toner manufacturing apparatus.
Figure 3:
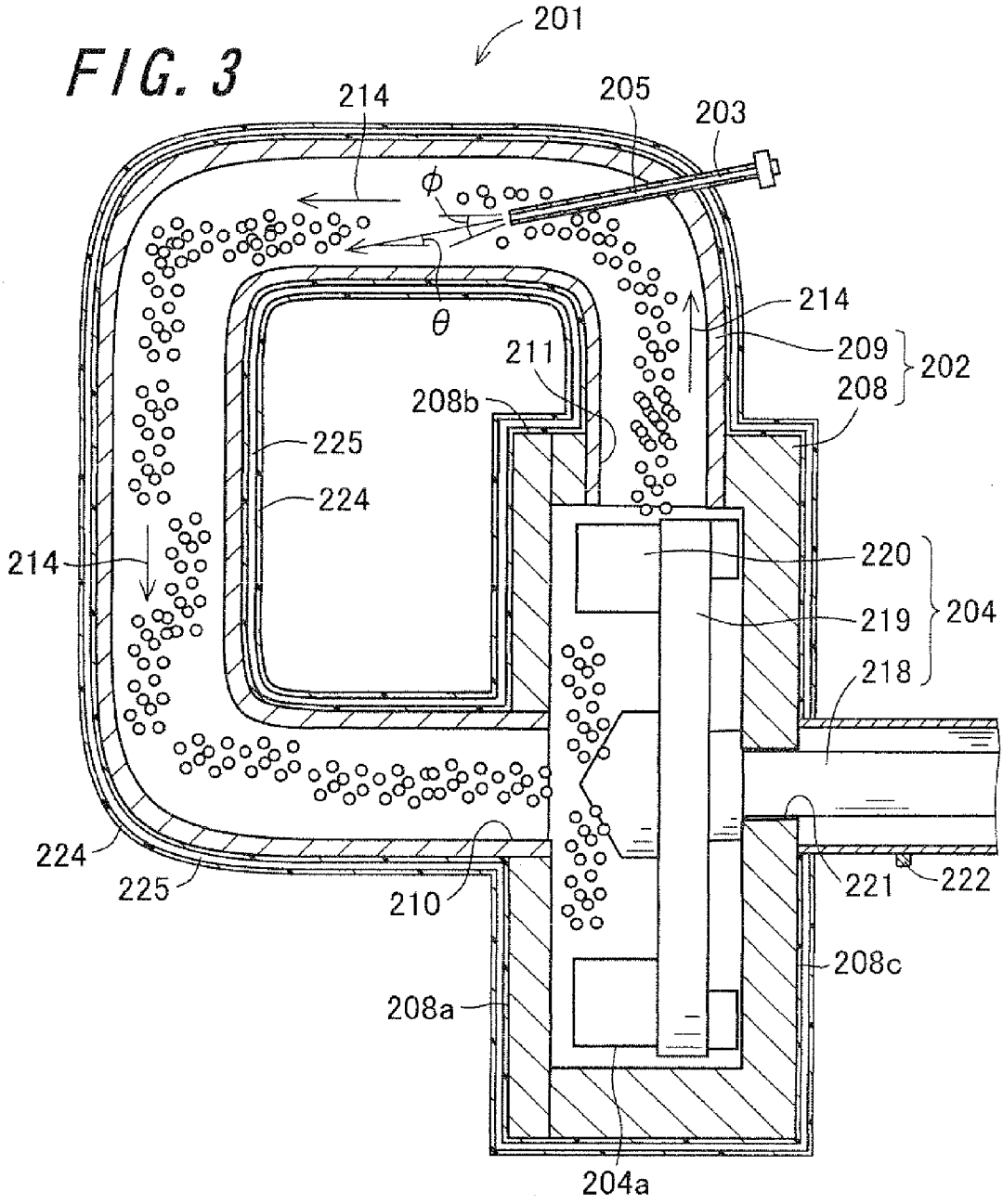
FIG. 3 is a sectional view of the toner manufacturing apparatus cut along the cross-sectional line A200-A200.
Figure 4:
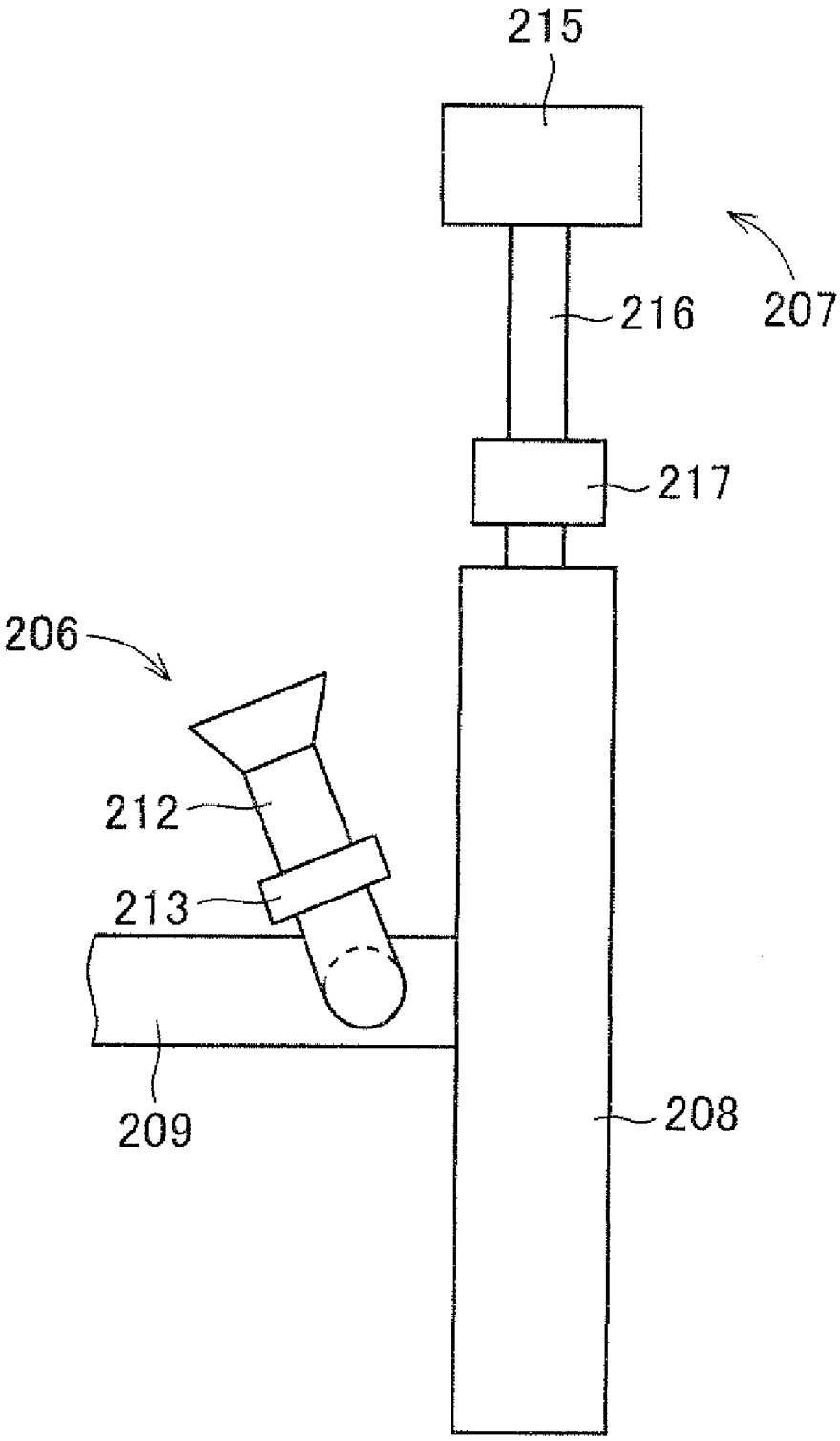
FIG. 4 is a side view of the toner manufacturing apparatus.

FIG. 2 is a front view of the toner manufacturing apparatus 201. FIG. 3 is a sectional view of the toner manufacturing apparatus 201 cut along the cross-sectional line A200-A200. FIG. 4 is a side view of the toner manufacturing apparatus 201. The toner manufacturing apparatus 201 comprises a powder passage 202, a spraying section 203, a rotary stirring section 204, a powder inputting section 206, a powder collecting section 207, and a temperature regulation jacket 224.

The powder passage 202 has interior space for fluidizing toner core particles, fine resin particles, a volatile liquid, carrier gas and the like. The powder passage 202 consists of a stirring chamber 208 and a powder flowing section 209.

The stirring chamber 208 is a cylindrical container-like member having an internal space. In the stirring chamber 208, opening sections 210 and 211 are formed. The opening section 210 is formed at an approximate center part of a wall section 208*a* which is one end wall section in the axial direction of the stirring chamber 208 so as to penetrate the wall section 208*a* in its thickness direction. The opening section 211 is formed to penetrate a wall section 208*b* which is perpendicular to the wall section 208*a* of the stirring chamber 208 in its thickness direction. Furthermore, in the stirring chamber 208, a through-hole 221 is formed. The through-hole 221 is formed so as to penetrate a wall section 208*c* which is a wall section parallel to the wall section 208*a* of the stirring chamber 208 in its thickness direction. Additionally, in the stirring chamber 208, the rotary stirring section 204 is provided.

The rotary stirring section 204 includes a rotary shaft section 218, a discotic rotary disc 219, a plurality of stirring blades 220, and a gas discharging section 222. The rotary shaft section 218 is a cylindrical-bar-shaped member that has an axis matching an axis of the stirring chamber 208, that is provided so as to be inserted in the through-hole 221, and that is rotated around the axis by a driving motor (not shown). The rotary shaft section 218 is rotatable at peripheral speed of 50 m/sec or more in an outermost periphery of the rotary stirring section 204. The outermost periphery of the rotary stirring section 204 is a part 204*a* of the stirring blades 220 that has the longest distance from the axis of the rotary shaft section 218 in the direction perpendicular to the extending direction of the rotary shaft member 218.

Moreover, the rotary shaft section 218 is a carrier gas supplying section that supplies carrier gas in the stirring chamber 208. In the rotary shaft section 218, a carrier gas supplying amount control section (not shown) is provided, and it is possible to adjust the supplying amount per unit time of the supplying carrier gas. Furthermore, in the rotary shaft section 218, a float type flowmeter (not shown) is provided and the supplying amount of the carrier gas is able to be measured. The rotary shaft section 218 is capable of preventing toner particles or the like to be discharged to the outside of the powder passage 202 from the gas discharging section 222 by sending carrier gas into the stirring chamber 208. Whereby a yield of toner is prevented from reducing, the flowing of toner into the motor is prevented, and increase of the consumption power due to increase of the load torque, and breakdown of the motor are able to be prevented. For the carrier gas, compressed air or the like is usable.

A rotary disc 219 is a discotic member having the axis supported by the rotary shaft section 218 so as to match the axis of the rotary shaft section 218 and rotating with rotation of the rotary shaft section 218. The plurality of stirring blades 220 are members that are supported by the rotary disc 219 and rotates with the rotation of the rotary disc 219. The stirring blade 220 is the rotary stirring section that imparts impact force to powder, carrier gas and the like by rotary stirring so that power, carrier gas and the like are fluidized in the powder passage 202. Powder, carrier gas and the like are, as shown by an arrow 214, fluidized so as to go out the stirring chamber 208 from the opening section 211 and enter into the stirring chamber 208 from the opening section 210.

The gas discharging section 222 is a discharging section that discharges gas in the powder passage 202. The gas in the powder passage 202 is comprised of carrier gas, vapor of a volatile liquid, and the like. By discharging vapor of the volatile liquid by way of the gas discharging section 222, a drying speed of the volatile liquid in the powder passage 202 is increased and aggregation of powder due to an undried volatile liquid can be prevented. Additionally, in the gas discharging section 222, a gas detector (not shown) is provided and the density of vapor of the volatile liquid in the gas discharged to the outside of the powder passage 202 is able to be measured. A plurality of gas detectors 222 may be provided.

The powder flowing section 209 is a cylindrical member having an internal space, one end thereof is connected to the opening section 210 and the other end is connected to the opening section 211. Whereby the internal space of the stirring chamber 208 communicates with the internal space of the powder flowing section 209, and the powder passage 202 is formed. In the powder flowing section 209, the spraying section 203, the powder inputting section 206 and the powder collecting section 207 are provided.

The powder inputting section 206 includes a hopper (not shown) that supplies the toner core particles and the fine resin particles, a supplying tube 212 that communicates the hopper and the powder passage 202, and an electromagnetic valve 213 provided in the supplying tube 212. The toner core particles and the fine resin particles supplied from the hopper are supplied to the powder passage 202 through the supplying tube 212 in a state where the passage in the supplying tube 212 is opened by the electromagnetic valve 213. The toner core particles and the fine resin particles supplied to the powder passage 202 flow in the flowing direction indicated by an arrow 214 with stirring by the rotary stirring section 204. Moreover, the toner core particles and the fine resin particles are not supplied to the powder passage 202 in a state where the passage in the supplying tube 212 is closed by the electromagnetic valve 213.

The powder collecting section 207 includes a collecting tank 215, a collecting tube 216 that communicates the collecting tank 215 and the powder passage 202, and an electromagnetic valve 217 provided in the collecting tube 216. The toner particles flowing through the powder passage 202 are collected in the collecting tank 215 through the collecting tube 216 in a state were the passage in the collecting tube 216 is opened by the electromagnetic valve 217. Moreover, the toner particles flowing in the powder passage 202 are not collected in a state where the passage in the collecting tube 216 is closed by the electromagnetic valve 217.

The spraying section 203 is a spraying section that is provided in the vicinity of the opening section 211 of the powder flowing section 209. The spraying section 203 includes a liquid reservoir (not shown), a carrier gas supplying section (not shown), a two-fluid nozzle 205, and a spraying amount control section (not shown).

Carrier gas supplying section is a carrier gas supplying section that supplies carrier gas into the powder flowing section 209. In the carrier gas supplying section, a float type flowmeter (not shown) is provided and the supplying amount of the carrier gas is able to be measured.

The liquid reservoir retains the volatile liquid. In addition, the liquid reservoir includes a liquid feeding pump (not shown) and feeds a volatile liquid of an amount of a set value to the two-fluid nozzle 205.

The volatile liquid retained in the liquid reservoir is to soften the fine resin particles. The volatile liquid is preferably not to dissolve toner core particles and fine resin particles. Moreover, although the volatile liquid softening fine resin particles without dissolving is not particularly limited, from a point that being removed after spraying the volatile liquid, is preferably a volatile liquid that is more easily vaporized.

The two-fluid nozzle 205 is provided as being inserted to an opening formed on an outer wall of the powder passage 202 and mixes the volatile liquid and the carrier gas, and sprays the mixture into the powder passage 202. An angle θ formed by the spraying direction of the volatile liquid from the two-fluid nozzle 205 and the flowing direction of the powder is preferably 0° or more and 45° or less.

Here, the spraying direction of the volatile liquid is a direction of the axis of the two-fluid nozzle 205. In a case where the angle θ falls within this range, the droplet of the volatile liquid is prevented from recoiling from the inner wall of the powder passage 202 and a yield of the toner core particles (toner particles) in which a resin layer is formed on the surface thereof is able to be further improved. In a case where the angle θ exceeds 45°, the droplet of the volatile liquid easily recoils from the inner wall of the powder passage 202 and the volatile liquid is easily retained. Thus generating aggregation of the toner core particles and deteriorating the yield of the toner. The two-fluid nozzle 205 is more preferably provided so as to be the angle θ=0°, that is such that the flowing direction of the powder is parallel to the spraying direction of the volatile liquid. Thereby, the spray droplets from the spray section 203 flow in the same direction as the powder, and the recoil is able to be further suppressed.

Further, a spreading angle ϕ of spray by the two-fluid nozzle 205 is preferably 20° or more and 90° or less. In a case where the spreading angle ϕ falls out of this range, it is difficult to spray the volatile liquid uniformly to the toner core particles.

The spraying amount control section adjusts the spraying amount per unit time of the volatile liquid supplied from the liquid reservoir, and the supplying amount per unit time of the carrier gas supplied from the carrier gas supplying section respectively.

The temperature regulation jacket 224 is provided at least on a part of wall section of the powder passage 202. The temperature regulation jacket 224 is provided on an outer wall surface of the wall section of the powder passage 202, temperature in the powder passage 202 is regulated to be constant by passing a cooling medium or a heating medium through passage 225 inside the jacket, and adhesion of the toner core particles is prevented. The temperature regulation jacket 224 is preferably provided on a part of the wall section of the powder passage 202 in which the toner core particles easily adhere.

For example, the temperature regulation jacket 224 is provided on a part of the wall section of the powder flowing section 209, which is in downstream of the flowing direction of the spraying section 203. By providing the temperature regulation jacket 224 in this manner, a state in which the sprayed spray liquid is retained without being dried is prevented. Thus; adhesion of the toner core particles to the inner wall face of the powder passage 202 and the aggregation of the toner core particles are able to be prevented.

Additionally, the temperature regulation jacket 224 is provided on a part of the wall section of the stirring chamber 208, near the opening section 210. By providing the temperature regulation jacket 224 in this manner, the toner core particles are prevented from adhering to the vicinity of the opening section 210 by collision of the toner core particles that flow from the opening section 210 into the stirring chamber 208 with the toner core particles that flow into the stirring chamber 208. Furthermore, the temperature regulation jacket 224 is preferably provided on the entire wall section of the powder flowing section 209 and a part of the wall section the stirring chamber 208, and more preferably provided on the entire wall section of the powder passage 202. By providing the temperature regulation jacket 224 in this manner, it is possible to prevent the toner core particles from adhering to the inner wall surface of the powder passage 202 more reliably.

The toner manufacturing apparatus 201 as described above can be also obtained by combining a commercially available stirring apparatus and the spraying apparatus. Examples of the commercially available stirring apparatus provided with a powder passage and a rotary stirring section include HYBRIDIZATION SYSTEM (trade name) manufactured by Nara Machinery Co., Ltd. By installing a spraying apparatus spraying the volatile liquid in the stirring apparatus, the stirring apparatus is usable as the toner manufacturing apparatus 201 used for the toner manufacturing method of the invention.

(3) First Temperature Regulation Step S2

At the first temperature regulation step S2, a temperature in the powder passage 202 is regulated to an initial temperature at the stirring step S3 with rotation of the rotary stirring section 204. The temperature in the powder passage 202 is regulated by passing a temperature regulation medium such as water through a temperature regulation jacket 224 provided on the outer wall surface in the wall part of the powder passage 202. The time taken for the first temperature regulation step S2 is for 10 to 30 minutes, and the temperature in the powder passage 202 is regulated to 5° C. to 20° C. by the temperature regulation jacket 224.

At the first temperature regulation step S2, the temperature in the powder passage 202 is preferably regulated to be 55° C. or lower. Whereby, it is possible to sufficiently disintegrate the secondary aggregate of the fine resin particles at the subsequent stirring step S3. Moreover, after disintegrating the fine resin particles, by using the temperature rise in the powder passage 202 due to the stirring of the toner core particles and the fine resin particles, it is possible to adhere and immobilize the fine resin particles on the surfaces of the toner core particles. Accordingly, at the subsequent spraying step S5, it is possible to form a resin layer whose thickness is further uniform on the surface of the toner core particle. Furthermore, at the stirring step S3, it is possible to prevent adhesion of the toner core particles and the fine resin particles to the inside of the rotary stirring section 204 and the powder passage 202, and the yield is able to be further improved.

In this manner, the temperature in the powder passage 202 is able to be preferably set before performing the stirring step S3 by performing the first temperature regulation step S2. Therefore, at the stirring step S3, the toner core particles and the fine resin particles are further able to be prevented from adhering to the wall surface inside the powder passage 202, and a fine resin particle layer whose thickness is uniform is able to be formed.

(4) Stirring Step S3

When the first temperature regulation step S2 is finished, the stirring step S3 is started. At the stirring step S3, from a powder inputting section, toner core particles and fine resin particles in which fine inorganic particles adhere to the surfaces thereof are supplied to the powder passage 202 to rotate the rotary stirring section 204. The toner core particles supplied to the powder passage 202 are stirred by the rotary stirring section 204 to flow through the powder flowing section 209 to the direction indicated by an arrow 214.

Fine resin particles supplied to the powder passage 202 are stirred by the rotary stirring section 204 to flow through the powder flowing section 209 to the direction indicated by the arrow 214 similarly to the toner core particles with the fine inorganic particles adhering to the surfaces thereof. The secondary aggregate of the fine resin particles supplied from the powder inputting section 206 are disintegrated to an about one time to ten times particle size of a primary particle size by stirring.

In this manner, the toner core particles with the fine inorganic particles adhering to the surfaces thereof and the fine resin particles disintegrated flow together, and thereby the toner core particles that the fine inorganic particles and the fine resin particles adhere to the surfaces thereof are prepared. When the fine resin particles are fixed to the surfaces of the toner core particles and the flowing speed of the powder is stabilized, the rotation of the rotary stirring section 204 is stopped to collect the toner core particles with the fine inorganic particles and the fine resin particles adhering to the surfaces thereof. The time taken for the stirring step S3 is for 2 to 10 minutes, and the temperature in the powder passage 202 is regulated to from 10° C. to a glass transition point of the toner core particle by the temperature regulation jacket 224.

At the stirring step S3, the temperature in the powder passage 202 is preferably not higher than a glass transition point of the fine resin particle. Furthermore, the temperature in the powder passage 202 is more preferably not higher than a glass transition point of the toner core particle. Whereby, the secondary aggregate of the fine resin particles are able to be stably disintegrated. Moreover, softening of the toner core particles and the fine resin particles due to rise of the temperature in the powder passage 202 caused by flowing and stirring of the toner core particles and the fine resin particles, is able to be suppressed. Thereby, aggregation of the toner core particles and fine resin particles as well as adhesion of the toner core particles and the fine resin particles to the inner wall surface of the powder passage 202 are able to be prevented.

Additionally, at the stirring step S3, the peripheral speed in an outermost periphery of the rotary stirring section 204 is preferably 50 m/sec or more and 120 m/sec or less. When the peripheral speed in the outermost periphery is within this range, it is possible to have sufficient impact force on the powder to form a fine resin particle layer whose thickness is more uniform as well as to suppress at a given level or lower a heat quantity generated by collision of the rotary stirring section 204 and the powder. Thereby, it is possible to suppress aggregation of particles and adhesion of the powder to the wall surface inside the powder passage 202.

When the peripheral speed in the outermost periphery is 50 m/sec or less, it is difficult to flow the toner core particles and the fine resin particles separately as well as to form a fine resin particle layer whose thickness is uniform on the surface of the toner core particle.

(5) Second Temperature Regulation Step S4

When the stirring step S3 is finished, a second temperature regulation step S4 is started. At the second temperature regulation step S4, a temperature in the powder passage 202 is regulated to an initial temperature at the spraying step S5 with rotation of the rotary stirring section 204. The temperature in the powder passage 202 is adjusted by passing a temperature regulation medium through the temperature adjusting jacket 224, similarly to the first temperature regulation step S2. The time taken for the second temperature regulation step S4 is for 10 to 30 minutes, and the temperature in the powder passage 202 is regulated to 5° C. to 20° C. by the temperature regulation jacket 224.

At the second temperature regulation step S4, it is preferable that the temperature in the powder passage 202 is regulated to 50° C. or higher and 55° C. or lower. Thereby, the fine resin particles on the surfaces of the toner core particles are able to be softened sufficiently at the subsequent spraying step S5 and it is thus possible to form a fine resin particle layer whose thickness is more uniform on the surface of the toner core particle. Further, it is possible to prevent the toner core particles and the fine resin particles from adhesion and aggregation in the rotary stirring section 204 and the wall surface inside the powder passage 202, and the yield is able to be improved.

When the temperature in the powder passage 202 exceeds 55° C., the toner core particles are too softened in the powder passage 202, which may cause generation of aggregation of the toner core particles. Additionally, when the temperature in the powder passage 202 is lower than 50° C., a drying speed of a volatile liquid is delayed, which may cause adhesion and aggregation of the toner core particles and the fine resin particles to the rotary stirring section 204 and the wall surface inside the powder passage 202.

In this manner, the temperature in the powder passage 202 is able to be preferable before performing the spraying step S5 by performing the second temperature regulation step S4, it is thus possible to further suppress adhesion of the toner core particles and the fine resin particles to the wall surface inside the powder passage 202 as well as to form a fine resin particle layer whose thickness is uniform.

(6) Spraying Step S5

When the second temperature regulation step S4 is finished, the spraying step S5 is started. At the spraying step S5, first, the toner core particles with the fine inorganic particles and the fine resin particles adhering to the surfaces thereof are inputted from the powder inputting section 206.

At the spraying step S5, after inputting the toner core particles, when a flowing speed of the powder in the powder passage 202 is stabilized, a volatile liquid is sprayed from the spraying section 203. At the time, a spraying amount of the volatile liquid is 0.2 mL/min to 2 mL/min.

Additionally, while spraying the volatile liquid, carrier gas is supplied in the powder passage 202 from the spraying section 203 and a rotary shaft section 218. The carrier gas that is supplied from the spraying section 203 and the rotary shaft section 218 is discharged from a gas discharging section 222 to the outside of the toner manufacturing apparatus 201. At the time, vapor of the volatile liquid is also discharged to the outside of the toner manufacturing apparatus 201 together with the carrier gas.

A carrier gas supplying amount from the spraying section 203 and the rotary shaft section 218, and a carrier gas discharging amount from the gas discharging section 222 are preferable to be approximately same. When the carrier gas discharging amount is too small compared with the carrier gas supplying amount, the vapor concentration of the volatile liquid in the gas existed in the toner manufacturing apparatus 201 is risen excessively, and the evaporation of the volatile liquid is not to be proceeded. As a result, aggregation of the toner core particles and the fine resin particles may be caused, and the toner core particles or the fine resin particles adhere to the volatile liquid adhering to the inner wall surface of the powder passage 202, whereby accumulation of other particles may be caused by the adhered particles as cores, and the yield is lowered. Furthermore, by the accumulation of other particles, the flowing passage for fluidizing the powder is narrowed, and the toner core particles and the fine resin particles are prevented from being isolated and fluidized, and the thickness of the fine resin particle layer becomes further non-uniform. On the other hand, when the carrier gas discharging amount is too much compared with the carrier gas supplying amount, the flowing out of the powder from the gas discharging section 222 to the outside of the toner manufacturing apparatus 201 is remarkable, and the yield is lowered. Furthermore, flowing into the rotary shaft section 218 of the powder is occurred and enlarging a load to the motor and increase of power consumption are caused.

The toner core particles and the fine resin particles adhering to the toner core particles have, with a volatile liquid sprayed from the spraying section 203 in a state of flowing through the powder flowing section 209, a volatile liquid adhering to the respective surfaces. Thereby, the toner core particles and the fine resin particles are softened. The fine resin particles are further softened due to a synergistic effect of the volatile liquid and thermal energy added by flowing in the powder passage 202 and stirring by the rotary stirring section 204 to make a consecutive film on the surface of the toner core particle, and thus a fine resin particle layer is formed on the surface of the toner core particle.

At the spraying step S5, when a required amount of a volatile liquid for forming a fine resin particle layer is sprayed, spraying of the volatile liquid from the spraying section 203 is finished, and the rotary stirring section 204 is continued to be rotated for the predetermined time to circulate the toner core particles and the fine resin particles repeatedly in the powder passage 202.

At the spraying step S5, after a lapse of the predetermined time from finishing spraying, the rotary stirring section 204 is stopped to rotate. At the spraying step S5, the time taken for spraying the volatile liquid is for 2 to 20 minutes and the predetermined time is for 2 to 10 minutes. Further, a temperature in the powder passage 202 at the spraying step S5 is regulated to 25° C. to 60° C. by the temperature regulation jacket 224.

It is preferable that a temperature in the powder passage 202 is not higher than a glass transition point of the toner core particle, and more preferably is 25° C. or higher and the glass transition point of the toner core particle or lower. The temperature in the powder passage 202 is approximately uniform in every part in the powder passage 202 due to flowing of the toner core particles. When the temperature in the powder passage 202 exceeds the glass transition point of the toner core particle, the toner core particles are too softened in the powder passage 202 to cause generation of aggregation of the toner core particles.

Additionally, when the temperature in the powder passage 202 is lower than 25° C., a drying speed of a volatile liquid is delayed, which may cause adhesion and aggregation of the toner core particles and the fine resin particles to the rotary stirring section 204 and the wall surface inside the powder passage 202.

Further, at the spraying step S5, the volatile liquid preferably contains lower alcohol. As lower alcohol, for example, methanol, ethanol, propanol, butanol and the like are included. The contained amount of the lower alcohol is, in order to be evaporated sufficiently quickly and soften fine resin particles sufficiently, preferably 90% or more relative to the entire volatile liquid.

By using the volatile liquid including such lower alcohol, it is possible to enhance wettability of the fine resin particles with respect to the toner core particles. Whereby, adhesion, deformation and film-forming of the fine resin particles are easily performed over the entire surface or a large part of the toner core particles. Further, since the alcohol has a high drying speed, the time taken for removing the volatile liquid is able to be further shortened. Whereby, aggregation of toner core particles is able to be suppressed. Additionally, the volatile liquid containing alcohol is hard to dissolve resin, thus dissolving of the toner core particles is able to be suppressed.

Further, the viscosity of the volatile liquid is preferably 5 cP or less. Here, the viscosity of the volatile liquid is a value measured at 25° C. The viscosity of the volatile liquid can be measured, for example, by a cone/plate type rotation viscometer. A preferable example of the volatile liquid having the viscosity of 5 cP or less includes the alcohol mentioned above (such as methanol or ethanol). These alcohols have the low viscosity and are easily vaporized, and therefore, minute spraying is possible without coarsening a diameter of the spray droplet to be sprayed from the spraying section 203. Thereby, it is possible to spray the liquid with a uniform droplet diameter.

It is also possible to further promote fining of the droplet by the collision of the toner core particles and the droplet. This makes it possible to manufacture a toner in which a resin layer whose thickness is uniform by wetting and acclimating the surfaces of the toner core particles and the fine resin particles and softening the fine resin particles by a synergetic effect with the volatile liquid and collision energy.

Therefore, by using the liquid containing alcohol as a volatile liquid, a fine resin particle layer whose thickness is uniform is able to be formed on the surface of the toner core particle. Furthermore, it is possible to suppress generation of aggregate by the toner core particles and the fine resin particles, and adhesion of the toner core particles and the fine resin particles to the inner wall surface of the toner manufacturing apparatus 201, and to manufacture the toner.

Additionally, at the spraying step S5, while spraying a volatile liquid, it is preferable that the vapor concentration of the volatile liquid in gas which is discharged from the gas discharging section is 3 [vol %] or less, and more preferably is 0.1 [vol %] or more and 3 [vol %] or less. When the vapor concentration of the volatile liquid is within this range, the toner core particles and the fine resin particles are able to be softened sufficiently, and thereby, it is possible to manufacture a toner in which a fine resin particle layer whose thickness is uniform is formed, and the sprayed volatile liquid is sufficiently dried. Consequently, it is possible to suppress aggregation of the powders and adhesion of the powder to the wall surface inside the powder passage 202, and a toner is able to be manufactured at a higher yield.

Further, at the spraying step S5, it is preferable that a peripheral speed in an outermost periphery of the rotary stirring section 204 is 50 m/sec or more and 120 m/sec or less. When the peripheral speed in the outermost periphery is within this range, since sufficient impact force is applied to the powder to be able to form a fine resin particle layer whose thickness is uniform as well as not applying excess impact force, it is possible to suppress at a given level or lower a heat quantity generated by collision of the rotary stirring section 204 and the powder. Thereby, it is possible to suppress aggregation of particles and adhesion of the powder to the wall surface inside the powder passage 202.

(7) Collecting Step S6

After the spraying step S5 is finished, the collecting step S6 is started. At the collecting step S6, toner core particles (toner particles) in which a fine resin particle layer is formed on the surface thereof are discharged to the outside of the toner manufacturing apparatus 201 and collected by the powder collecting section 207. Time taken for the collecting step S6 is for 1 minute to 2 minutes, and the temperature in the powder passage 202 in the collecting step S5 is regulated to 25° C. to 60° C. by the temperature regulation jacket 224.

According to the toner manufacturing process as described above, since the fine resin particles is disintegrated at the stirring step S3 before the spraying step S5, the fine resin particles in the disintegrated state are able to adhere to the surfaces of the toner core particles. Thereafter, the fine resin particles are spread on by spraying of the volatile liquid, and the thickness of the fine resin particle layer is able to be uniform and exposure of the surface of the toner core particle is able to be prevented.

When the volatile liquid is sprayed to the toner core particles and the fine resin particles in a state where the aggregation of the fine resin particles has not been disintegrated in order to try to form the fine resin particle layer, the aggregated fine resin particles adhere to the surface of the toner core particle to form a film, and the fine resin particle layer whose thickness is non-uniform is formed.

Additionally, according to a toner manufacturing process, in toner core particles with fine inorganic particles adhering to the surfaces thereof, secondary aggregate of fine resin particles is hard to adhere at the stirring step S3 compared to toner core particles with fine inorganic particles not adhering to the surfaces thereof, and therefore fine resin particles adhere uniformly to each part of the surfaces of the toner core particles. Further, the volatile liquid sprayed at the spraying step S5 is absorptively retained by the fine inorganic particles adhering to the surfaces of the toner core particles so that it is possible to suppress an evaporation speed of the volatile liquid adhering to the surfaces of the toner core particles. Accordingly, it is possible to soften the fine resin particles adhering to the surface of the toner core particle by spraying a relatively small amount of the volatile liquid. Consequently, it is possible to form, on the surface of the toner core particle, a fine resin particle layer whose thickness is uniform while suppressing the adhesion of the toner core particles and the fine resin particles to the wall surface inside the toner manufacturing apparatus 201.

Here, spraying a relatively small amount of a volatile liquid refers to an approximately 0.2 mL/min to 2 mL/min spraying amount of spraying per hour of a volatile liquid, while spraying of a relatively large amount of a volatile liquid refers to an approximately 2 mL/min to 10 mL/min spraying amount of spraying per hour of the volatile liquid. Further, even in a case where the spraying amount per hour is within a range of 0.2 mL/min to 2 mL/min, when the time taken for spraying of the volatile liquid exceeds 20 minutes, a relatively large amount of the volatile liquid is sprayed.

At the toner manufacturing process, even by a relatively large amount of spraying, it is possible to obtain a toner having a fine resin particle layer whose thickness is uniform. However, when a relatively large amount of spraying is performed, a yield of a toner is lowered. Therefore, it is preferable that a relatively small amount of spraying is performed.

Additionally, as described above, the fine inorganic particle includes at least one of silica, titanium oxide and metatitanic acid. Since silica, titanium oxide and metatitanic acid are hard to aggregate on the surface of the toner core particle or the surface of the fine resin particle, the amount of a volatile liquid that is absorptively retained by the fine inorganic particles is uniform in each part of the surface. Therefore, it is possible to form a fine resin particle layer whose thickness is more uniform on the surface of the toner core particle.

Further, as described above, the fine inorganic particle includes at least one of silica whose surface is treated with hexamethyldisilazane, and titanium oxide and metatitanic acid whose surfaces are treated with trimethylchlorosilane. Since the fine inorganic particles adhering to the surface of the toner core particle or the surface of the fine resin particle are further hard to aggregate by surface treatment, which causes uniform dispersion to the surfaces of the toner core particles or the surfaces of the fine resin particles, the amount of the volatile liquid that is absorptively retained by the fine inorganic particles becomes more uniform in each part of the surface. Consequently, it is possible to form a fine resin particle layer whose thickness is more uniform on the surface of the toner core particle.

Further, as described above, the fine inorganic particles adhering to the surface of the toner core particle have a number average particle size of 12 nm or more and 40 nm or less. Thereby, it is possible to further suppress fixing of secondary aggregate of the fine resin particles on the surface of the toner core particle. Moreover, the toner core particle with the fine inorganic particles whose number average particle size is 12 nm or more and 40 nm or less adhering to the surface thereof is able to absorptively retain more volatile liquids. Accordingly, it is possible to form a fine resin particle layer whose thickness is more uniform on the surface of the toner core particle while further suppressing adhesion of the toner core particles and the fine resin particles to the wall surface inside the toner manufacturing apparatus 201.

Further, as described above, the toner core particles with the fine inorganic particles adhering to the surfaces thereof are the toner core particles with the fine inorganic particles adhering to the surfaces of the toner core particles so as to have a 0.2% or more and 5% or less additive ratio by weight. In this manner, when the total weight of the fine inorganic particles adhering to the surfaces of the toner core particles is preferable for the weight of the toner core particles, it is possible to form a fine resin particle layer whose thickness is uniform having sufficient strength on the surfaces of the toner core particles while suppressing an evaporation speed of a volatile liquid.

When having large weight in total of the fine inorganic particles adhering to the surface of the toner core particle, the fine resin particles are prevented from adhering to be immobilized in the toner core particle and a fine resin particle layer to be formed may be easy to come off. Additionally, fixation properties of a toner may be lowered due to a large amount of the fine inorganic particles.

On the other hand, when having small weight in total of the fine inorganic particles adhering to the surface of the toner core particle, the toner core particles are incapable of absorptively retaining a volatile liquid as appropriate so that an evaporation speed of the volatile liquid is not able to be suppressed. Additionally, it is also impossible to suppress adhesion of secondary aggregate of the fine resin particles to the toner core particles. Therefore, a fine resin particle layer whose thickness is non-uniform may be formed.

A preferable range of the additive ratio by weight described above is calculated as follows. When ½ of the value of a particle size of toner core particles is defined as R, true specific gravity of the toner core particle is defined as $\rho_R$, ½ of the value of a number-average particle size of fine inorganic particles adhering to the toner core particle is defined as r, true specific gravity of the fine inorganic particle is defined as $\rho_r$, the number of the fine inorganic particle is defined as $n_r$ and an additive ratio by weight is defined as P[%], the following expression is estimated:

$$P=(4/3\pi r^3\rho_r n_r)/(4/3\pi R^3\rho_R)\times 100 \quad (1).$$

Additionally, all fine inorganic particles adhering to the surface of the toner core particle are, ideally, spherical and adhere to the surface of the toner core particle with no space. In such an ideal case, when the number of a fine inorganic particle adhering to the surface of a toner core particle is defined as $n_i$, $$n_i=(4\pi R^2)/(\pi r^2)\times C \quad (2)$$

(where, C is 0.907 defined as a filling rate coefficient in a case where a circle is arranged with closest packing.)

In the toner manufacturing process, it is preferable that the relation between $n_r$ and $n_i$ satisfies the following expression:

$$n_i\times 50\% \leqq n_r \leqq n_i\times 150\% \quad (3)$$

When the value of $n_r$ is within this range, a toner core particle with a fine inorganic particle adhering to the surface thereof is able to absorptively retain a volatile liquid sufficiently. Additionally, the toner core particle is able to further suppress adhesion of secondary aggregate of a fine resin particle. From formulas (1) to (3) described above, the following expressions are developed:

$$P_i=4C\times(r\rho_r)/(R\rho_R)\times 100 \quad (4),$$

$$P_i\times 50\% \leqq P \leqq P_i\times 150\% \quad (5).$$

It is possible to obtain toner core particles whose additive ratio by weight of fine inorganic particles is P, by stirring and mixing P parts by weight of fine inorganic particles based on 100 parts by weight of a toner core particle.

For example, in a case where a particle size of toner core particles is 6.5 μm, true specific gravity $\rho_R$ of a toner core particle is 1.2, a number average particle size of fine inorganic particles is 7 nm and true specific gravity $\rho_r$ of a fine inorganic particle is 2, $P_i$=0.651 and a preferable range of P is 0.326≦P≦0.977. It is possible to obtain toner core particles whose P=0.651 [%] by stirring and mixing 0.651 part by weight of fine inorganic particles based on 100 parts by weight of a toner core particle.

True specific gravity of the toner core particle according to the invention is approximately 1.1 to 1.3, and true specific gravity of the fine inorganic particle according to the invention is approximately 1.8 to 4.2. Additionally, as described above, a volume average particle size of the toner core particles is preferably 4 μm or more and 7 μm or less, and a number average particle size of the fine inorganic particles is preferably 12 nm or more and 40 nm or less. Accordingly, a lower limit value of P is developed as:

$$4C\times(12\text{ nm}/2\times 1.8)/(7\ \mu\text{m}/2\times 1.3)\times 100\times 50\%=0.43 \quad (6).$$

Further, an upper limit value of P is developed as:

$$4C\times(40\text{ nm}/2\times 4.2)/(4\ \mu\text{m}/2\times 1.1)\times 100\times 150\%=6.9 \quad (7).$$

In this manner, a formula where 0.43 [%]≦P [%]≦6.9 [%] is theoretically developed. Actually, it is preferable that fine inorganic particles are added so that 0.2 [%]≦P [%]≦7.0 [%], and more preferably, 0.2 [%]≦P [%]≦5.0 [%].

Additionally, in the toner manufacturing process, it is preferable that a fine resin particle is a fine resin particle in which fine inorganic particles whose number average particle size is 12 nm or more and 40 nm or less adhere to the surface thereof. In this case, the fine resin particles with the fine inorganic particles adhering the surfaces thereof may be prepared in other steps before the stirring step S3, and at the stirring step S3, may be prepared by stirring the fine resin particles in which the fine inorganic particles do not adhere thereto and the fine inorganic particles by the toner manufacturing apparatus 201.

In a case where the fine resin particles with the fine inorganic particles adhering to the surfaces thereof are prepared by the toner manufacturing apparatus 201, the fine inorganic particles and the fine resin particles may be stirred for 10 to 300 seconds by adjusting the peripheral speed in an outermost periphery of the rotary stirring section 204 to 20 m/sec to 50 m/sec and regulating the temperature in the powder passage 202 to 20° C. to 50° C.

In this manner, the fine resin particles in which the fine inorganic particles whose number average particle size is 12 nm or more and 40 nm or less adhere to the surfaces thereof are hard to adhere to the surface of the toner core particle in a state of secondary aggregate since the fine inorganic particles adhere to the surface thereof. Moreover, it is possible to suppress reaggregate of the fine resin particles which are disintegrated from a state of secondary aggregate since the fine inorganic particles adhere to the surfaces thereof. Therefore, the fine resin particles adhere uniformly to each part of the surface of the toner core particle.

Additionally, the volatile liquid sprayed at the spraying step S5 is absorptively retained by the fine inorganic particles adhering to the surface of the fine resin particle to suppress an evaporation speed of the volatile liquid adhering to the surfaces of the fine resin particles. Accordingly, it is possible to soften the fine resin particles adhering to the surface of the toner core particle by spraying a relatively small amount of the volatile liquid. Consequently, it is possible to form, on the surface of the toner core particle, a fine resin particle layer whose thickness is more uniform while further suppressing the adhesion of the toner core particles and the fine resin particles to the wall surface inside the toner manufacturing apparatus 201.

Furthermore, in the present embodiment, manufacturing of a toner is performed by using the toner manufacturing apparatus 201 provided with the temperature regulation jacket 224, by passing a heating medium or a cooling medium through the passage 225, regulation of the temperature in each of the steps S2 to S6 is able to be performed.

Specifically, at the stirring step S3, by regulating the inside of the powder passage 202 to a predetermined temperature, the fine resin particles are able to be adhering to the surfaces of the toner core particles at a temperature that the toner core particles and the fine resin particles are not softened and deformed. Whereby, adhesion of the fine resin particles to the toner core particles is able to be proceeded smoothly. Therefore, at the subsequent spraying step S5, the resin layer whose thickness is uniform is able to be formed.

Additionally, it is possible to suppress the adhesion of the toner core particles and the fine resin particles to the wall surface inside the powder passage 202 by performing the temperature regulation, and also to prevent from narrowing the inside of the powder passage 202 by the toner core particles and the fine resin particles. Accordingly, it is possible to manufacture at a high yield a toner with superior cleaning characteristics having a fine resin particle layer whose thickness is uniform formed on the surface of the toner core particle.

Furthermore, specifically, at the spraying step S5, by regulating the inside of the powder passage 202 to a predetermined temperature, variation in the temperatures applied to the toner core particles, the fine resin particles and the volatile liquid due to time is able to be reduced. Whereby, the toner core particles and the fine resin particles are able to be stably fluidized. Additionally, by performing regulation of the temperature in the powder passage 202, adhesion of the toner core particles and the fine resin particles to the inner wall surface of the powder passage 202 due to excessive temperature rise is also able to be suppressed. Furthermore, adhesion of the toner core particles and the fine resin particles to the inner wall surface of the powder passage 202 due to retention of the volatile liquid in the powder passage 202 and narrowing inside the powder passage 202 due to this are able to be prevented. Accordingly, it is possible to manufacture at a high yield a toner with superior cleaning characteristics having a fine resin particle layer whose thickness is uniform formed on the surface of the toner core particle.

Further, a stirring stable temperature as the temperature in the powder passage 202 which is stable after a lapse of a constant time from the starting of the step at the stirring step S3 is preferably a spraying stable temperature or lower as a temperature in the powder passage 202 which is stable after a lapse of a constant time from the starting of the step at the spraying step S5. Whereby, at the stirring step S3, the fine resin particles are able to be immobilized on the surfaces of the toner core particles while reducing the exposure of the surfaces of the toner core particles, and at the spraying step S5, spreading processing of the fine resin particles is able to be performed stably. Therefore, a toner in which a fine resin particle layer whose surface has less irregularities and whose thickness is uniform is formed is able to be manufactured.

Further, the temperature in the powder passage 202 after a lapse of a predetermined time from the starting of the step at the stirring step S3 is preferably not higher than a temperature in the powder passage 202 which is stable after a lapse of the same predetermined time from the starting of the step at the spraying step S5. Whereby, at the stirring step S3, softening of the fine resin particles are able to be suppressed and the secondary aggregate of the fine resin particles are able to be sufficiently disintegrated. Thus, the disintegrated fine resin particles are able to adhere to the surfaces of the toner core particles uniformly.

Further, at the spraying step S5, spreading processing of the fine resin particles adhering to the surfaces of the toner core particles is able to be performed stably. Accordingly, a toner in which a fine resin particle layer whose thickness is uniform is formed is able to be manufactured.

In the embodiment, the same apparatus is used for performing the stirring step S3 and the spraying step S5 as the toner manufacturing apparatus 201. Thereby, facility investment is conducted inexpensively as well as space-saving for an installation location is able to be made.

In other embodiments of the invention, the toner core particles with the fine inorganic particles adhering to the surfaces thereof, at the stirring step S3, may be prepared by stirring the toner core particles in which the fine inorganic particles do not adhere thereto and the fine inorganic particles by the toner manufacturing apparatus 201 before supplying the fine resin particles.

At the stirring step S3, by the toner manufacturing apparatus 201, when the toner core particles with the fine inorganic particles adhering to the surfaces thereof are prepared, the fine inorganic particles and the toner core particles may be stirred for 10 to 30 seconds by adjusting the peripheral speed in an outermost periphery of the rotary stirring section 204 to 20 m/sec to 50 m/sec and regulating the temperature in the powder passage 202 to 20° C. to 50° C.

Additionally, in other embodiments of the invention, it is considered that collecting of the toner core particles at the stirring step S3 and inputting the toner core particles at the spraying step S5 are not performed. That is, after stopping the rotary stirring section 204, the second temperature regulation step S4 is performed while leaving the toner core particles with the fine resin particles adhering to the surfaces thereof in the powder passage 202, and steps after the spraying step S5 are performed by rotating the rotary stirring section 204 when the temperature in the powder passage 202 reaches a predetermined temperature.

Since the second temperature regulation step S4 is performed in a state of stopping the rotary stirring section 204 so that the fine resin particles on the surfaces of the toner core particles are prevented from forming films while regulating the temperature, it is possible to form a resin fin particle layer whose thickness is uniform, similarly to the embodiment where the toner core particles are collected and inputted.

Further, in other embodiments of the invention, two units of the toner manufacturing apparatus may be used for manufacturing a toner. Hereinafter, one of the toner manufacturing apparatuses is referred to as a first manufacturing apparatus and another toner manufacturing apparatus is referred to as a second manufacturing apparatus. The first manufacturing apparatus and the second manufacturing apparatus are configured similarly to the toner manufacturing apparatus 201. For example, the first manufacturing apparatus is used as an apparatus for performing the stirring step S3, and the second manufacturing apparatus is used as an apparatus for performing the spraying step S5.

In this case, the first manufacturing apparatus and the second manufacturing apparatus may be apparatuses having the exact same structure as well as be apparatuses having different structure. Thereby, when manufacturing a plurality of toners, the spraying step S5 is performed by the second manufacturing apparatus, and at the same time of performing the step, it is possible to perform continuous parallel processing in which the stirring step S3 for manufacturing a toner different from the toner manufactured in the above step is performed by the first manufacturing apparatus. When performing the continuous parallel processing, it is possible to improve productivity of a toner per unit time compared to the case where a plurality of toners are manufactured without performing the continuous parallel processing. Specifically, in a case where the continuous parallel processing is performed, it is possible to improve productivity of a toner by about 20% compared to which the continuous parallel processing is not performed.

2. Toner

A toner according to the invention is obtained by a method of manufacturing a toner according to the invention. An embodiment of a toner according to the invention includes a toner obtained by the toner manufacturing process described above.

A toner obtained by the toner manufacturing process is a toner in which a thickness of a fine resin particle layer is uniform. Accordingly, this toner is, in which enclosed components of toner particles are protected, excellent in durability and preservation stability. Furthermore, in this toner, an adhering amount of the fine resin particles is uniform between the individual toner particles, and therefore the toner characteristics such as charging characteristics are uniform between the individual toner particles. Thus, by using this toner, it is possible to form an image with high definition and high image quality without unevenness in the concentration for a long time.

Further, an external additive may be added to this toner. As the external additive, heretofore known substances can be used including silica and titanium oxide. It is preferred that these external additives be surface-treated with silicone resin and a silane coupling agent. A preferable usage of the external additive is 1 part by weight to 10 parts by weight based on 100 parts by weight of the toner.

3. One-Component Developer

A one-component developer according to the invention includes a toner according to the invention. As an embodiment of the one-component developer according to the invention, one consisting of only the toner described above is included. With such one-component developer, it is possible to form an image with high definition and high image quality without unevenness in the concentration for a long time.

When using the toner described above as the one component developer, a toner is frictionally charged by using a blade, a fur brush or the like, and the toner is transported by being adhered on a developing sleeve to perform image formation.

4. Two-Component Developer

A two-component developer according to the invention contains a toner according to the invention and a carrier. As an embodiment of the two-component developer according to the invention, one that contains the toner described above and a heretofore known carrier is included. With such two-component developer, it is possible to form an image with high definition and high image quality without unevenness in the concentration for a long time.

As the heretofore known carrier, examples thereof include single or complex ferrite composed of iron, copper, zinc, nickel, cobalt, manganese, and chromium; a resin-coated carrier having carrier core particles whose surfaces are coated with coating substances; and a resin-dispersion carrier in which magnetic particles are dispersed in resin. As the coating substance, heretofore known substances can be used including polytetrafluoroethylene, a monochloro-trifluoroethylene polymer, polyvinlidene-fluoride, silicone resin, polyester, a metal compound of di-tertiary-butylsalicylic acid, styrene resin, acrylic resin, polyamide, polyvinyl butyral, nigrosine, aminoacrylate resin, basic dyes or lakes thereof, fine silica powder, and fine alumina powder.

In addition, the resin used for the resin-dispersion carrier is not limited to particular resin, and examples thereof include styrene-acrylic resin, polyester resin, fluorine resin, and phenol resin. The resins used for the resin-dispersion carrier are preferably selected according to the toner components. Those resins listed above may be used each alone, and two or more thereof may be used in combination.

A particle of the carrier preferably has a spherical shape or flattened shape. A particle size of the carrier is not limited to a particular size, and in consideration of forming higher-quality images, the particle size of the carrier is preferably 10 μm to 100 μm and more preferably 20 μm to 50 μm. Further, the resistivity of the carrier is preferably $10^8$ Ω·cm or more, and more preferably $10^{12}$ Ω·cm or more.

The resistivity of the carrier is obtained as follows. At the outset, the carrier is put in a container having a cross section of 0.50 $cm^2$, thereafter being tapped. Subsequently, a load of 1 $kg/cm^2$ is applied by use of a weight to the carrier particles which are held in the container as just stated. When an electric field of 1,000 V/cm is generated between the weight and a bottom electrode of the container by application of voltage, a current value is read. The current value indicates the resistivity of the carrier. When the resistivity of the carrier is low, electric charges will be injected into the carrier upon application of bias voltage to a developing sleeve, thus causing the carrier particles to be more easily attached to the photoreceptor. In this case, the breakdown of bias voltage is more liable to occur.

Magnetization intensity (maximum magnetization) of the carrier is preferably 10 emu/g to 60 emu/g and more preferably 15 emu/g to 40 emu/g. The magnetization intensity depends on magnetic flux density of a developing roller. Under the condition of ordinary magnetic flux density of the developing roller, however, no magnetic binding force work on the carrier having the magnetization intensity less than 10 emu/g, which causes the carrier to spatter. When the carrier has the magnetization intensity exceeding 60 emu/g, bushes of the carrier are too large, and therefore, in the case of non-contact development, it is difficult to keep the non-contact state with the image bearing member, whereas in the case of contact development, sweeping streaks are liable to appear on a toner image.

A using proportion of the toner and the carrier is not particularly limited, and is selectable as appropriate depending on a type of a toner and a carrier, however, concerning a resin coating carrier (density of 5 g/cm$^2$ to 8 g/cm$^2$) as an example, in the two-component developer, a toner is used so that 2% by weight to 30% by weight, preferably 2% by weight to 20% by weight of a toner relative to a total amount of the two component developer is contained. Furthermore, in the two-component developer, a coating rate of a carrier by a toner is preferably 40% to 80%.

5. Developing Device and Image Forming Apparatus

A developing device according to the invention performs developing by using the one-component developer according to the invention or the two-component developer according to the invention. Furthermore, an image forming apparatus according to the invention is provided with the developing device according to the invention. In the following, description will be given for a developing device 14 as an embodiment of the developing device according to the invention, and an image forming apparatus 100 as an embodiment of the image forming apparatus according to the invention.

Figure 5:
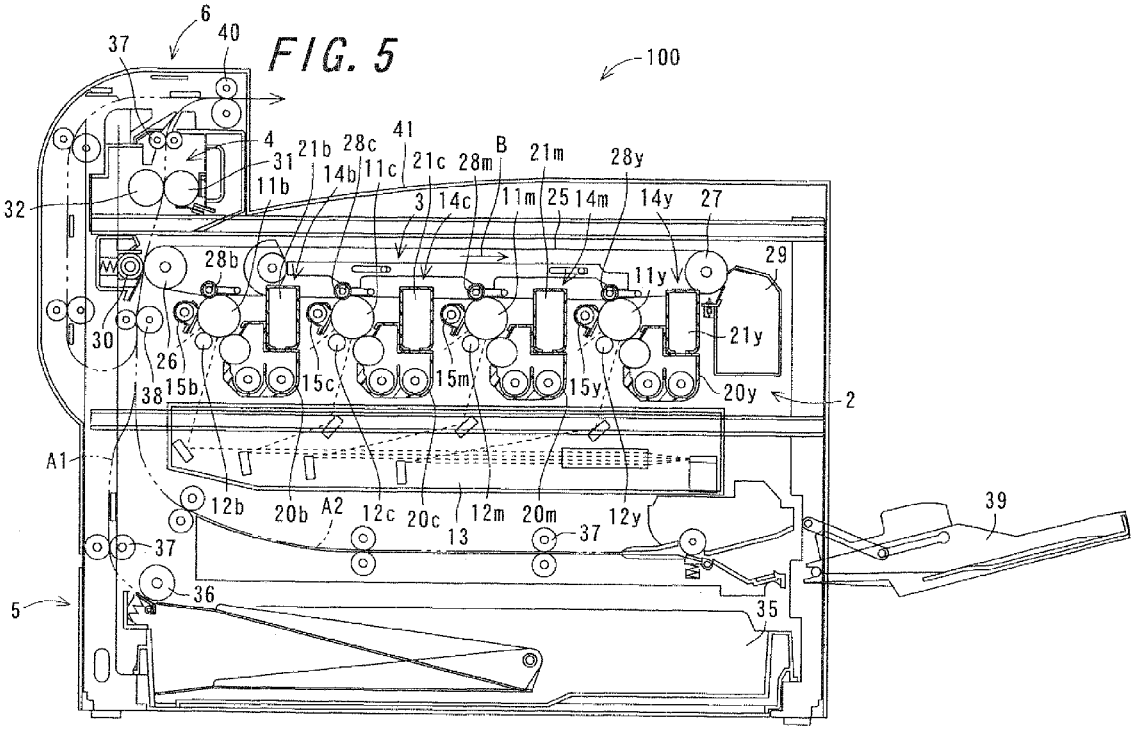
FIG. 5 is a schematic view schematically showing a cross section of an image forming apparatus.

FIG. 5 is a schematic view schematically showing a configuration of an image forming apparatus 100 according to a fourth embodiment of the invention. The image forming apparatus 100 is a multifunctional peripheral which combines a copier function, a printer function, and a facsimile function. In the image forming apparatus 100, according to image information transmitted thereto, a full-color or black-and-white image is formed on a recording medium. That is to say, the image forming apparatus 100 has three print modes of a copier mode, a printer mode, and a facsimile mode, one of which print modes is selected by a control unit (not shown) in response to an operation input given by an operating section (not shown) or a print job given by a personal computer, a mobile computer, an information record storage medium, or an external equipment having a memory unit.

The image forming apparatus 100 includes a toner image forming section 2, a transfer section 3, a fixing section 4, a recording medium feeding section 5, and a discharging section 6. In accordance with image information of respective colors of black (b), cyan (c), magenta (m), and yellow (y) which are contained in color image information, there are provided respectively four sets of the components constituting the toner image forming section 2 and some parts of the components contained in the transfer section 3. The four sets of respective components provided for the respective colors are distinguished herein by giving alphabets indicating the respective colors to the end of the reference numerals. Further, in the case where the respective components are collectively referred to, alphabets are not given to the end of the reference numerals.

The toner image forming section 2 includes a photoreceptor drum 11, a charging section 12, an exposure unit 13, a developing device 14, and a cleaning unit 15. The charging section 12, the developing device 14, and the cleaning unit 15 are disposed in the order just stated around the photoreceptor drum 11. The charging section 12 is disposed vertically below the developing device 14 and the cleaning unit 15.

The photoreceptor drum 11 is supported by a driving section (not shown) so as to be capable of rotationally driving around an axis and includes a conductive substrate (not shown) and a photosensitive layer (not shown) formed on the surface of the conductive substrate. The conductive substrate may be various shapes including a cylindrical shape, a columnar shape, or a thin film sheet shape, for example. Among them, the cylindrical shape is preferable. The conductive substrate is formed by a conductive material. As a conductive material, one commonly used in the field is usable, for example, metals such as aluminum, copper, brass, zinc, nickel, stainless steel, chrome, molybdenum, vanadium, indium, titanium, gold and platinum; alloys formed of two or more thereof; a conductive film in which a conductive layer containing one or two or more of aluminum, aluminum alloy, tin oxide, gold, indium oxide and the like is formed on a film-like substrate such as synthetic resin film, metal film, and paper; and a resin composition containing at least one of conductive particles and conductive polymers. Note that, as the film-like substrate used for the conductive film, a synthetic resin film is preferred and a polyester film is particularly preferred. Further, as the method of forming the conductive layer in the conductive film, vapor deposition, coating and the like are preferred.

The photosensitive layer is formed, for example, by stacking a charge generating layer containing a charge generating substance, and a charge transporting layer containing a charge transporting substance. In this case, an undercoat layer is preferably formed between the conductive substrate and the charge generating layer or the charge transporting layer. When the undercoat layer is provided, the flaws and irregularities present on the surface of the conductive substrate are covered, leading to advantages such that the photosensitive layer has a smooth surface, that chargeability of the photosensitive layer can be prevented from degrading during repetitive use, and that the chargeability of the photosensitive layer can be enhanced under at least either a low temperature circumstance or a low humidity circumstance. Further, a laminated photoreceptor is also applicable which has a highly-durable three-layer structure having a photoreceptor surface-protecting layer provided on the uppermost layer.

The charge generating layer contains as a main substance a charge generating substance that generates charges under irradiation of light, and optionally contains known binder resin, plasticizer, sensitizer and the like. As the charge generating substance, materials used customarily in the relevant field can be used including, for example, perylene pigments such as perylene imide and perylenic acid anhydride; polycyclic quinone pigments such as quinacridone and anthraquinone; phthalocyanine pigments such as metal and non-metal phthalocyanines, and halogenated non-metal phthalocyanines; squalium dyes; azulenium dyes; thiapyrylium dyes; and azo pigments having carbazole skeleton, styrylstilbene skeleton, triphenylamine skeleton, dibenzothiophene skeleton, oxadiazole skeleton, fluorenone skeleton, bisstilbene skeleton, distyryloxadiazole skeleton, or distyryl carbazole skeleton. Among those charge generating substances, non-metal phthalocyanine pigments, oxotitanyl phthalocyanine pigments, bisazo pigments containing at least one of fluorene rings and fluorenone rings, bisazo pigments containing aromatic amines, and trisazo pigments have high charge generating ability and are suitable for forming a highly-sensitive photosensitive layer.

The charge generating substances may be used each alone, or two or more of them may be used in combination. The content of the charge generating substance is not particularly limited, and preferably from 5 parts by weight to 500 parts by weight and more preferably from 10 parts by weight to 200 parts by weight based on 100 parts by weight of the binder resin in the charge generating layer. Also as the binder resin for charge generating layer, materials used customarily in the relevant field can be used including, for example, melamine resin, epoxy resin, silicone resin, polyurethane, acrylic resin, vinyl chloride-vinyl acetate copolymer resin, polycarbonate, phenoxy resin, polyvinyl butyral, polyallylate, polyamide, and polyester. The binder resins may be used each alone, or optionally two or more of them may be used in combination.

The charge generating layer can be formed by dissolving or dispersing an appropriate amount of a charge generating substance, a binder resin and, optionally, a plasticizer, a sensitizer and the like, respectively in an appropriate organic solvent which is capable of dissolving or dispersing the substances described above, to thereby prepare a coating solution for charge generating layer, and then applying the coating solution for charge generating layer to the surface of the conductive substrate, followed by drying. The thickness of the charge generating layer obtained in this way is not particularly limited, and preferably from 0.05 μm to 5 μm, and more preferably from 0.1 μm to 2.5 μm.

The charge transporting layer stacked over the charge generating layer contains as essential substances a charge transporting substance having an ability of receiving and transporting charges generated from the charge generating substance, and binder resin for charge transporting layer, and optionally contains known antioxidant, plasticizer, sensitizer, lubricant and the like. As the charge transporting substance, materials used customarily in the relevant field can be used including, for example: electron donating substances such as poly-N-vinyl carbazole and a derivative thereof, poly-γ-carbazolyl ethyl glutamate and a derivative thereof, a pyrene-formaldehyde condensation product and a derivative thereof, polyvinylpyrene, polyvinyl phenanthrene, an oxazole derivative, an oxadiazole derivative, an imidazole derivative, 9-(p-diethylaminostyryl)anthracene, 1,1-bis(4-dibenzylaminophenyl)propane, styrylanthracene, styrylpyrazoline, a pyrazoline derivative, phenyl hydrazones, a hydrazone derivative, a triphenylamine compound, a tetraphenyldiamine compound, a triphenylmethane compound, a stilbene compound, and an azine compound having 3-methyl-2-benzothiazoline ring; and electron accepting substances such as a fluorenone derivative, a dibenzothiophene derivative, an indenothiophene derivative, a phenanthrenequinone derivative, an indenopyridine derivative, a thioquisantone derivative, a benzo[c]cinnoline derivative, a phenazine oxide derivative, tetracyanoethylene, tetracyanoquinodimethane, bromanil, chloranil, and benzoquinone.

The charge transporting substances may be used each alone, or two or more of them may be used in combination. The content of the charge transporting substance is not particularly limited, and preferably from 10 parts by weight to 300 parts by weight and more preferably from 30 parts by weight to 150 parts by weight based on 100 parts by weight of the binder resin in the charge transporting layer. As the binder resin for charge transporting layer, it is possible to use materials which are used customarily in the relevant field and capable of uniformly dispersing the charge transporting substance, including, for example, polycarbonate, polyallylate, polyvinylbutyral, polyamide, polyester, polyketone, epoxy resin, polyurethane, polyvinylketone, polystyrene, polyacrylamide, phenolic resin, phenoxy resin, polysulfone resin, and copolymer resin thereof. Among those materials, in view of the film forming property, and the wear resistance, an electrical property etc. of the obtained charge transporting layer, it is preferable to use, for example, polycarbonate which contains bisphenol Z as the monomer ingredient (hereinafter referred to as "bisphenol Z polycarbonate"); and a mixture of bisphenol Z polycarbonate and other polycarbonate. The binder resin may be used each alone, or two or more of them may be used in combination.

The charge transporting layer preferably contains an antioxidant together with the charge transporting substance and the binder resin for charge transporting layer. For the antioxidant, substances used customarily in the relevant field can be used including, for example, vitamin E, hydroquinone, hindered amine, hindered phenol, paraphenylene diamine, arylalkane and derivatives thereof, an organic sulfur compound, and an organic phosphorus compound.

The antioxidants may be used each alone, or two or more of them may be used in combination. The content of the antioxidant is not particularly limited, and is 0.01% by weight to 10% by weight and preferably 0.05% by weight to 5% by weight of the total amount of the ingredients constituting the charge transporting layer. The charge transporting layer can be formed by dissolving or dispersing an appropriate amount of a charge transporting substance, binder resin and, optionally, an antioxidant, a plasticizer, a sensitizer and the like respectively in an appropriate organic solvent which is capable of dissolving or dispersing the ingredients described above, to hereby prepare a coating solution for charge transporting layer, and applying the coating solution for charge transporting layer to the surface of a charge generating layer followed by drying. The thickness of the charge transporting layer obtained in this way is not particularly limited, and preferably 10 μm to 50 μm and more preferably 15 μm to 40 μm. Note that it is also possible to form a photosensitive layer in which a charge generating substance and a charge transporting substance are present in one layer. In this case, the kind and content of the charge generating substance and the charge transporting substance, the kind of the binder resin, and other additives may be the same as those in the case of forming separately the charge generating layer and the charge transporting layer.

In the embodiment, there is used a photoreceptor drum which has an organic photosensitive layer as described above containing the charge generating substance and the charge transporting substance. It is, however, also possible to use, instead of the above photoreceptor drum, a photoreceptor drum which has an inorganic photosensitive layer containing silicon or the like.

The charging section 12 faces the photoreceptor drum 11 and is disposed away from the surface of the photoreceptor drum 11 longitudinally along the photoreceptor drum 11. The charging section 12 charges the surface of the photoreceptor drum 11 so that the surface of the photoreceptor drum 11 has predetermined polarity and potential. As the charging section 12, it is possible to use a charging brush type charging device, a charger type charging device, a pin array type charging device, an ion-generating device, etc. Although the charging section 12 is disposed away from the surface of the photoreceptor drum 11 in the embodiment, the configuration is not limited thereto. For example, a charging roller may be used as the charging section 12, and the charging roller may be disposed in pressure-contact with the photoreceptor drum. It is also possible to use a contact-charging type charger such as a charging brush or a magnetic brush.

The exposure unit 13 is disposed so that a light beam corresponding to each color information emitted from the exposure unit 13 passes between the charging section 12 and the developing device 14 and reaches the surface of the photoreceptor drum 11. In the exposure unit 13, the image information is converted into light beams corresponding to each color information of b, c, m, and y, and the surface of the photoreceptor drum 11 which has been evenly charged by the charging section 12, is exposed to the light beams corresponding to each color information to thereby form electrostatic latent images on the surfaces of the photoreceptor drums 11. As the exposure unit 13, it is possible to use a laser scanning unit having a laser-emitting portion and a plurality of reflecting mirrors. The other usable examples of the exposure unit 13 may include an LED (Light Emitting Diode) array or a unit in which a liquid-crystal shutter and a light source are appropriately combined with each other.

Figure 6:
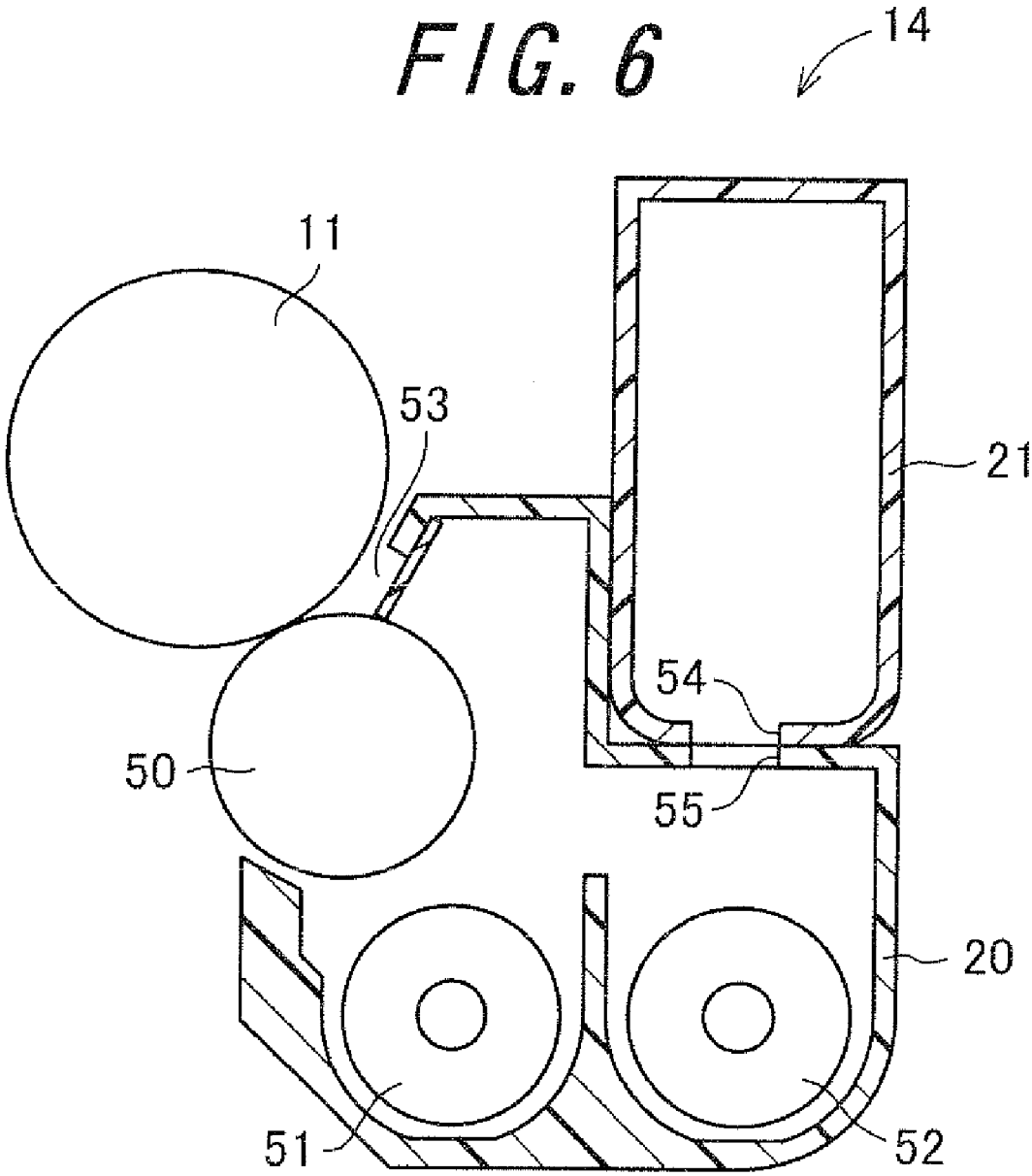
FIG. 6 is a schematic view schematically showing a cross section of a developing device.

FIG. 6 is a schematic view schematically showing a cross section of the developing device 14. The developing device 14 includes a developer tank 20 and a toner hopper 21. A developer used for the developing device 14 is the one-component developer or the two-component developer described above.

The developer tank 20 is a container-shaped member which is disposed so as to face the surface of the photoreceptor drum 11, supplies a toner to an electrostatic latent image formed on the surface of the photoreceptor drum 11 to be developed, and forms a toner image as a visualized image. The developer tank 20 contains in an internal space thereof the developer, and contains and supports roller members such as a developing roller 50, a supplying roller 51, and a stirring roller 52 or screw members so as to rotate freely. An opening 53 is formed in a side face of the developer tank 20 to face the photoreceptor drum 11, and on a position opposite to the photoreceptor drum 11 through the opening 53, a developing roller 50 is provided so as to be capable of rotationally driving.

The developing roller 50 is a roller-shaped member for supplying a toner to the electrostatic latent image on the surface of the photoreceptor 11 at a pressure-contact portion or most-adjacent portion between the developing roller 50 and the photoreceptor drum 11. In supplying the toner, to the surface of the developing roller 50, a potential whose polarity is opposite to a polarity of a charged potential of the toner is applied, which serves as a development bias voltage. By so doing, the toner on the surface of the developing roller 50 is smoothly supplied to the electrostatic latent image. Furthermore, an amount of the toner being supplied to the electrostatic latent image (a toner attachment amount) is able to be controlled by changing a value of the development bias voltage. The supply roller 51 is a roller-shaped member which is provided facing to the developing roller 50 so as to be capable of rotationally driving, and supplies the toner to the vicinity of the developing roller 50. The stirring roller 52 is a roller-shaped member which is provided facing the supplying roller 51 so as to be capable of rotationally driving, and feeds to the vicinity of the supplying roller 51 the toner which is newly supplied from the toner hopper 21 into the developer tank 20.

The toner hopper 21 is disposed so as to communicate a toner replenishment port 54 formed in a vertically lower part of the toner hopper 21, with a toner reception port 55 formed in a vertically upper part of the developing tank 20. The toner hopper 21 replenishes the developing tank 20 with the toner according to toner consumption. Further, it may be possible to adopt such configuration that the developing tank 20 is replenished with the toner supplied directly from a toner cartridge of each color without using the toner hopper 21.

The cleaning unit 15 removes the toner which remains on the surface of the photoreceptor drum 11 after the toner image has been transferred to the recording medium, and thus cleans the surface of the photoreceptor drum 11. In the cleaning unit 15, a platy member is used such as a cleaning blade. Note that, in the image forming apparatus 100, an organic photoreceptor drum is mainly used as the photoreceptor drum 11. A surface of the organic photoreceptor drum contains a resin component as a main ingredient and therefore tends to be degraded by chemical action of ozone which is generated by corona discharging of the charging section 12. The degraded surface part is, however, worn away by abrasion through the cleaning unit 15 and thus removed reliably, though gradually. Accordingly, the problem of the surface degradation caused by the ozone, etc. is actually solved, and it is thus possible to stably maintain the potential of charges given by the charging operation over a long period of time. Although the cleaning unit 15 is provided in the embodiment, no limitation is imposed on the configuration and the cleaning unit 15 does not have to be provided.

In the toner image forming section 2, signal light corresponding to the image information is emitted from the exposure unit 13 to the surface of the photoreceptor drum 11 which has been evenly charged by the charging section 12, thereby forming an electrostatic latent image; the toner is then supplied from the developing device 14 to the electrostatic latent image, thereby forming a toner image; the toner image is transferred to an intermediate transfer belt 25 described below; and the toner which remains on the surface of the photoreceptor drum 11 is removed by the cleaning unit 15. A series of toner image forming operations just described are repeatedly carried out.

The transfer section 3 is disposed above the photoreceptor drum 11 and includes the intermediate transfer belt 25, a driving roller 26, a driven roller 27, an intermediate transferring roller 28*b*, 28*c*, 28*m*, 28*y*, a transfer belt cleaning unit 29, and a transferring roller 30. The intermediate transfer belt 25 is an endless belt supported around the driving roller 26 and the driven roller 27 with tension, thereby forming a loop-shaped travel path, and rotates in a direction of an arrow B.

When the intermediate transfer belt 25 passes by the photoreceptor drum 11 in contact therewith, the transfer bias voltage whose polarity is opposite to the charging polarity of the toner on the surface of the photoreceptor drum 11 is applied from the intermediate transferring roller 28 which is disposed opposite to the photoreceptor drum 11 through the intermediate transfer belt 25, and the toner image formed on the surface of the photoreceptor drum 11 is transferred onto the intermediate transfer belt 25. In the case of a full-color image, the toner images of respective colors formed by the respective photoreceptor drums 11 are sequentially transferred onto the intermediate transfer belt 25 and overlaid on top of one another, thus forming a full-color image. The driving roller 26 is provided so as to be capable of rotationally driving about an axis thereof by a driving section (not shown), and by the rotational driving, the intermediate transfer belt 25 is rotationally driven in the direction indicated by the arrow B.

The driven roller 27 can be driven to rotate by the rotation of the driving roller 26, and imparts constant tension to the intermediate transfer belt 25 so that the intermediate transfer belt 25 does not go slack.

The intermediate transferring roller 28 is disposed in pressure-contact with the photoreceptor drum 11 with the intermediate transfer belt 25 interposed therebetween, and capable of rotating around its own axis by a driving section (not shown). The intermediate transferring roller 28 is connected to a power source (not shown) for applying the transfer bias voltage as described above, and has a function of transferring the toner image formed on the surface of the photoreceptor drum 11 to the intermediate transfer belt 25.

The transfer belt cleaning unit 29 is disposed opposite to the driven roller 27 with the intermediate transfer belt 25 interposed therebetween so as to come into contact with an outer circumferential surface of the intermediate transfer belt 25. When the intermediate transfer belt 25 contacts the photoreceptor drum 11, the toner is attached to the intermediate transfer belt 25 and may cause contamination on a reverse side of the recording medium, and therefore the transfer belt cleaning unit 29 removes and collects the toner on the surface of the intermediate transfer belt 25.

The transferring roller 30 is disposed in pressure-contact with the driving roller 26 with the intermediate transfer belt 25 interposed therebetween, and capable of rotating around its own axis by a driving section (not shown). In a pressure-contact portion (a transfer nip region) between the transferring roller 30 and the driving roller 26, a toner image which has been borne by the intermediate transfer belt 25 and thereby conveyed to the pressure-contact portion is transferred onto a recording medium fed from the later-described recording medium feeding section 5. The recording medium bearing the toner image is fed to the fixing section 4.

In the transfer section 3, the toner image is transferred from the photoreceptor drum 11 onto the intermediate transfer belt 25 in the pressure-contact portion between the photoreceptor drum 11 and the intermediate transferring roller 28, and by the intermediate transfer belt 25 rotating in the arrow B direction, the transferred toner image is conveyed to the transfer nip region where the toner image is transferred onto the recording medium.

The fixing section 4 is provided downstream of the transfer section 3 along a conveyance direction of the recording medium, and contains a fixing roller 31 and a pressure roller 32.

The fixing roller 31 can rotate by a driving section (not shown), and heats and fuses the toner constituting an unfixed toner image borne on the recording medium. Inside the fixing roller 31 is provided a heating portion (not shown). The heating portion heats the fixing roller 31 so that a surface of the fixing roller 31 has a predetermined temperature (heating temperature). For the heating portion, a heater, a halogen lamp, and the like device can be used, for example. The heating portion is controlled by the fixing condition controlling processing. In the vicinity of the surface of the fixing roller 31 is provided a temperature detecting sensor which detects a surface temperature of the fixing roller 31. A result detected by the temperature detecting sensor is written to a memory portion of the later-described control unit.

The pressure roller 32 is disposed in pressure-contact with the fixing roller 31, and supported so as to be driven to rotate by the rotation of the fixing roller 31. The pressure roller 32 fixes the toner image onto the recording medium in cooperation with the fixing roller 31. At this time, the pressure roller 32 assists in the fixation of the toner image onto the recording medium by pressing the toner in a fused state due to heat from the fixing roller 31, against the recording medium. A pressure-contact portion between the fixing roller 31 and the pressure roller 32 is a fixing nip region.

In the fixing section 4, the recording medium onto which the toner image has been transferred in the transfer section 3 is nipped by the fixing roller 31 and the pressure roller 32 so that when the recording medium passes through the fixing nip region, the toner image is pressed and thereby fixed onto the recording medium under heat, whereby an image is formed.

The recording medium feeding section 5 includes an automatic paper feed tray 35, a pickup roller 36, conveying rollers 37, registration rollers 38, and a manual paper feed tray 39.

The automatic paper feed tray 35 is disposed in a vertically lower part of the image forming apparatus 100 and in form of a container-shaped member for storing the recording mediums. Examples of the recording medium include plain paper, color copy paper, sheets for overhead projector, and postcards.

The pickup roller 36 takes out sheet by sheet the recording mediums stored in the automatic paper feed tray 35, and feeds the recording mediums to a paper conveyance path A1. The conveying rollers 37 are a pair of roller members disposed in pressure-contact with each other, and convey the recording medium to the registration rollers 38. The registration rollers 38 are a pair of roller members disposed in pressure-contact with each other, and feed to the transfer nip region the recording medium fed from the conveying rollers 37 in synchronization with the conveyance of the toner image borne on the intermediate transfer belt 25 to the transfer nip region. The manual paper feed tray 39 is a member for taking recording mediums into the image forming apparatus 100, and recording mediums stored in the manual paper feed tray 39 are different from the recording mediums stored in the automatic paper feed tray 35 and may have any size. The recording medium taken in from the manual paper feed tray 39 passes through a paper conveyance path A2 by use of the conveying rollers 37, thereby being fed to the registration rollers 38.

In the recording medium feeding section 5, the recording medium supplied sheet by sheet from the automatic paper feed tray 35 or the manual paper feed tray 39 is fed to the transfer nip region in synchronization with the conveyance of the toner image borne on the intermediate transfer belt 25 to the transfer nip region.

The discharging section 6 includes the conveying rollers 37, discharging rollers 40, and a catch tray 41. The conveying rollers 37 are disposed downstream of the fixing nip region along the recording medium conveyance direction, and convey toward the discharging rollers 40 the recording medium onto which the image has been fixed by the fixing section 4. The discharging rollers 40 discharge the recording medium onto which the image has been fixed, to the catch tray 41 disposed on a vertically upper surface of the image forming apparatus 1. The catch tray 41 stores the recording medium onto which the image has been fixed.

The image forming apparatus 100 includes a control unit (not shown). The control unit is disposed, for example, in an upper part of an internal space of the image forming apparatus 100, and contains a memory portion, a computing portion, and a control portion. To the memory portion of the control unit are inputted, for example, various set values obtained by way of an operation panel (not shown) disposed on the vertically upper surface of the image forming apparatus 100, results detected from a sensor (not shown) etc. disposed in various portions inside the image forming apparatus 100, and image information obtained from an external equipment. Further, programs for executing various processings are written. Examples of the various processings include a recording medium determining processing, an attachment amount controlling processing, and a fixing condition controlling processing. For the memory portion, those customarily used in the relevant filed can be used including, for example, a read only memory (ROM), a random access memory (RAM), and a hard disk drive (HOD). For the external equipment, it is possible to use electrical and electronic devices which can form or obtain the image information and which can be electrically connected to the image forming apparatus 100. Examples of the external equipment include a computer, a digital camera, a television receiver, a video recorder, a DVD (Digital Versatile Disc) recorder, an HDDVD (High-Definition Digital Versatile Disc) recorder, a Blu-ray disc recorder, a facsimile machine, and a mobile computer. The computing portion of the control unit takes out the various data (such as an image formation order, the detected result, and the image information) written in the memory portion and the programs for various functional elements, and then makes various determinations. The control portion of the control unit sends to a relevant device a control signal in accordance with the result determined by the computing portion, thus performing control on operations. The control portion and the computing portion include a processing circuit which is achieved by a microcomputer, a microprocessor, etc. having a central processing unit. The control unit contains a main power source as well as the above-stated processing circuit. The power source supplies electricity to not only the control unit but also respective devices provided inside the image forming apparatus 100.

With the developing device 14 and the image forming apparatus 100, it is possible to form an image with high definition and high image quality without unevenness in the concentration for a long time.

Finally, the scope of the invention is indicated by the scope of claims rather than by the scope of embodiments described above. The above-described embodiments are to be considered in all respects as illustrative, the scope of the invention includes all other embodiments. That is the invention includes a part for all of the above-described embodiments and all embodiments changed within the scope of claims and within a range of equivalency of the scope of claims.

EXAMPLES

Hereinafter, description will be given specifically for the invention with Examples and Comparative Examples for comparison to Examples of the invention. In what follows, "parts" and "%" mean "parts by weight" and "% by weight" respectively, unless otherwise noted. The measurement was conducted as follows for viscosity of a liquid, a glass transition point of binder resin and toner core particles, a softening point of binder resin, a melting point of a release agent, and a number average particle size of toner core particles, a fine resin particle and a fine inorganic particle.

[Glass Gransition Point of Binder Resin and Toner Core Particle]

Using a differential scanning calorimeter (trade name: DSC220, manufactured by Seiko Instruments & Electronics Ltd.), 1 g of specimen (binder resin or toner core particles) was heated at a temperature increasing rate of 10° C./min to measure a DSC curve based on Japanese Industrial Standards (JIS) K7121-1987. A temperature at an intersection of a straight line that was elongated toward a low-temperature side from a base line on the high-temperature side of an endothermic peak corresponding to glass transition of the obtained DSC curve and a tangent line that was drawn so that a gradient thereof was maximum against a curve extending from a rising part to a top of the peak was obtained as the glass transition point ($T_g$).

[Softening Point of Binder Resin]

Using a flow characteristic evaluation apparatus (trade name: FLOW TESTER CFT-1000, manufactured by Shimadzu Corporation), 1 g of specimen (binder resin) was heated at a temperature increasing rate of 6° C./min, under load of 20 kgf/cm$^2$ ($19.6\times10^5$ Pa) so that the specimen was pushed out of a dye (nozzle opening diameter of 1 mm and length of 1 mm) and a temperature at the time when a half of the specimen had flowed out of the dye was obtained as the softening point ($T_m$).

[Melting Point of Release Agent]

Using the differential scanning calorimeter (trade name: DSC220, manufactured by Seiko Instruments & Electronics Ltd.), 1 g of specimen (release agent) was heated from a temperature of 20 up to 200° C. at a temperature increasing rate of 10° C./min, and then an operation of rapidly cooling down from 200° C. to 20° C. was repeated twice, thus measuring a DSC curve. A temperature at a top of an endothermic peak corresponding to the melting on the DSC curve measured at the second operation, was obtained as the melting point of the release agent.

[Volume Average Particle Size of Toner Core Particles]

To 50 ml of electrolyte (trade name: ISOTON-II, manufactured by Beckman Coulter, Inc.), 20 mg of specimen (toner core particles) and 1 ml of sodium alkylether sulfate were added, and a thus-obtained admixture was subjected to dispersion processing of an ultrasonic distributor (trade name: desktop two-frequency ultrasonic cleaner VS-D100, manufactured by AS ONE Corporation) for three minutes at an ultrasonic frequency of 20 kHz, thereby preparing a specimen for measurement. The measurement sample was analyzed by a particle size distribution-measuring device: MULTISIZER III (trade name) manufactured by Beckman Coulter, Inc. under the conditions that an aperture diameter was 100 μm and the number of particles for measurement was 50,000 counts. A volume particle size distribution of the sample particles was thus obtained from which the volume average particle size was then determined.

[Volume Average Particle Size of Fine Resin Particles]

The measurement was conducted by using a laser diffraction/scattering type particle size distribution measuring apparatus (trade name: Microtrac MT 3000 manufactured by NIKKISO CO., LTD.) In order to prevent aggregation of a measurement sample (a fine resin particle), after inputting and stirring a dispersion liquid where the measurement sample is dispersed in an aqueous solution of FAMILY FRESH (manufactured by Kao Corporation), which was injected into the apparatus, and the measurement was conducted twice to obtain the average. Measuring conditions were set as the measurement time: 30 seconds, a particle refractive index: 1.4, a particle shape: nonsphericity, solvent: water, and a solvent refractive index: 1.33. Volume particle size distribution of the measurement sample was measured, and a particle size in which cumulative volume from a small-particle side in cumulative volume distribution is resulted in 50% from the measurement is calculated as a volume average particle size (μm) of particles.

[Number Average Particle Size of Fine Inorganic Particles]

A number average particle size was calculated as the average value after measuring 100 fine inorganic particles by using a scanning electron microscope (SEM).

[Toner Manufacturing Apparatus]

As a toner manufacturing apparatus, an apparatus provided with a spraying unit connected so as to feed a volatile liquid (ethanol) quantitatively to a two-fluid nozzle (trade name: HM-6 type, manufactured by Fuso Seiki Co., Ltd.) by passing a liquid-supply pump (trade name: SP11-12, manufactured by FLOM Co., Ltd.) through a hybridization system (trade name: NHS-1 type, manufactured by Nara Machinery Co., Ltd.) was used. An mounting angle of the two-fluid nozzle was set such that an angle between the spraying direction of the volatile liquid and the flowing direction of the powder is 0°. Additionally, the temperature regulation jacket 224 was provided in all wall parts of the powder passage 202. A chiller was used as a temperature regulation control apparatus of the temperature regulation jacket 224. Further, the gas discharging section 222 was provided with a gas detector (trade name: XP-3110, manufactured by New Cosmos Electric Co., Ltd.)

Example 1

<Particle Preparing Step S1>

[Toner Core Particle]

Polyester resin (trade name: DIACRON, manufactured by Mitsubishi Rayon Co., Ltd., glass transition point of 55° C., softening point of 130° C.) 87.5% (100 parts)

C. I. Pigment Blue 15:3 5.0% (5.7 parts)

Release agent (Carunauba Wax, melting point of 82° C.) 6.0% (6.9 parts)

Charge control agent (trade name: Bontron E84, manufactured by Orient Chemical Industries, Ltd.) 1.5% (1.7 parts)

The above each constituent was pre-mixed by a Henschel mixer (trade name: FM20C, manufactured by Mitsui Mining Co., Ltd.), and thereafter melt-kneading was conducted by a twin-screw extruder (trade name: PCM30, manufactured by Ikegai, Ltd.) The melt-kneaded product, after coarsely pulverizing by a cutting mill (trade name: VM-16, manufactured by Orient Co., Ltd.), was finely pulverized by a jet mill (manufactured by Hosokawa Micron Corporation), and was further classified by a pneumatic classifier (manufactured by Hosokawa Micron Corporation) to obtain toner core particles. The volume average particle size of the toner core particles was 6.5 μm and the glass transition temperature was 56° C.

[Fine Resin Particle]

By freeze-drying a polymerized product of styrene and butyl acrylate, styrene-butyl acrylate copolymer fine particles (a glass transition temperature is 72° C., and a softening point is 126° C.) whose volume average particle size is 0.1 μm were obtained as fine resin particles.

[Toner Core Particles to which Fine Inorganic Particles Adhere]

The toner core particles with fine inorganic particles adhering to the surfaces thereof were prepared by using a hybridization system conforming to the toner manufacturing apparatus 201 (trade name: NHS-1 type, manufactured by Nara Machinery Co., Ltd.) After regulating a temperature, 100 parts by weight of a toner core particle and 0.2 part by weight of fine silica particles having a number average particle size of 12 nm whose surface was treated by hexamethyldisilazane (HMDS) as a fine inorganic particle (trade name: AEROSIL RX200, manufactured by NIPPON AEROSIL CO., LTD.) were inputted into the hybridization system to be stirred for 15 seconds at peripheral speed of 50 m/sec in an outermost periphery of the rotary stirring section 204, and the toner core particles with fine inorganic particles adhering to the surfaces thereof were obtained. In the obtained toner core particles, the fine inorganic particles were dispersed uniformly on the surfaces of the toner core particles, and the additive ratio by weight of the fine inorganic particles to the toner core particles was 0.2.

<First Temperature Regulation Step S2>

At the first temperature regulation step S2, a circulating water temperature at the time of no-load before inputting the powder (toner core particles and fine resin particles to which fine inorganic particles are adhered) was set to 5° C., and at the stirring step S3, the temperature of the powder flowing section 209 indicated by a temperature sensor attached to the powder passage 202 was regulated so as to be 50° C.

<Stirring Step S3>

Into the above toner manufacturing apparatus, 100 parts by weight of a toner core particle to which a fine inorganic particle is adhered and 10 parts by weight of a fine resin particle were inputted to be stirred and mixed for 10 minutes with peripheral speed set to 80 m/sec in an outermost periphery of the rotary stirring section 204, and thereafter toner core particles with fine inorganic particles adhering to the surfaces thereof were taken from a powder collecting section 207 to be collected to a polyethylene storing bag. At that time, an air supplying amount from the rotary shaft section 218 was set to 5 per minute, an air supplying amount from a two-fluid nozzle 205 was set to 5 L per minute and an air discharging amount from the gas discharging section 222 was set to 10 L per minute.

In the toner core particles to which fine resin particle adhered, during the time between being collected to the storing bag and being inputted into the toner manufacturing apparatus at the spraying step S5, no worse conditions were seen such as generation of aggregation, for example.

<Second Temperature Regulation Step S4>

A circulating water temperature at the time of no-load before inputting the powder (toner core particles to which fine resin particles were adhered) was set to 25° C. at the second temperature regulation step S4, and a temperature of the powder flowing section 209 indicated by a temperature sensor attached to the powder passage 202 was regulated so as to be 55° C. at the spraying step S5.

<Spraying Step S5>

In the above toner manufacturing apparatus, periphery speed in an outermost periphery of the rotary stirring section 204 was set to 100 m/sec, and the spraying step S5 was performed.

The toner core particles to which fine resin particles prepared at the stirring step S3 were adhered were stirred for 5 minutes, then were sprayed with a 0.5 mL/min spraying amount of ethanol for 15 minutes. Thereafter, spraying ethanol was stopped, followed by stirring for 10 minutes, and the rotary stirring section 204 was stopped. At that time, an air supplying amount from the rotary shaft section 218 was set to 5 L per minute, an air supplying amount from the two-fluid nozzle 205 was set to 5 L per minute and an air discharging amount from the gas discharging section 222 was set to 10 L per minute. While spraying ethanol, a vapor concentration of ethanol in the gas discharged from the gas discharging section 222 was stable at about 1.4 vol %.

Figure 7:
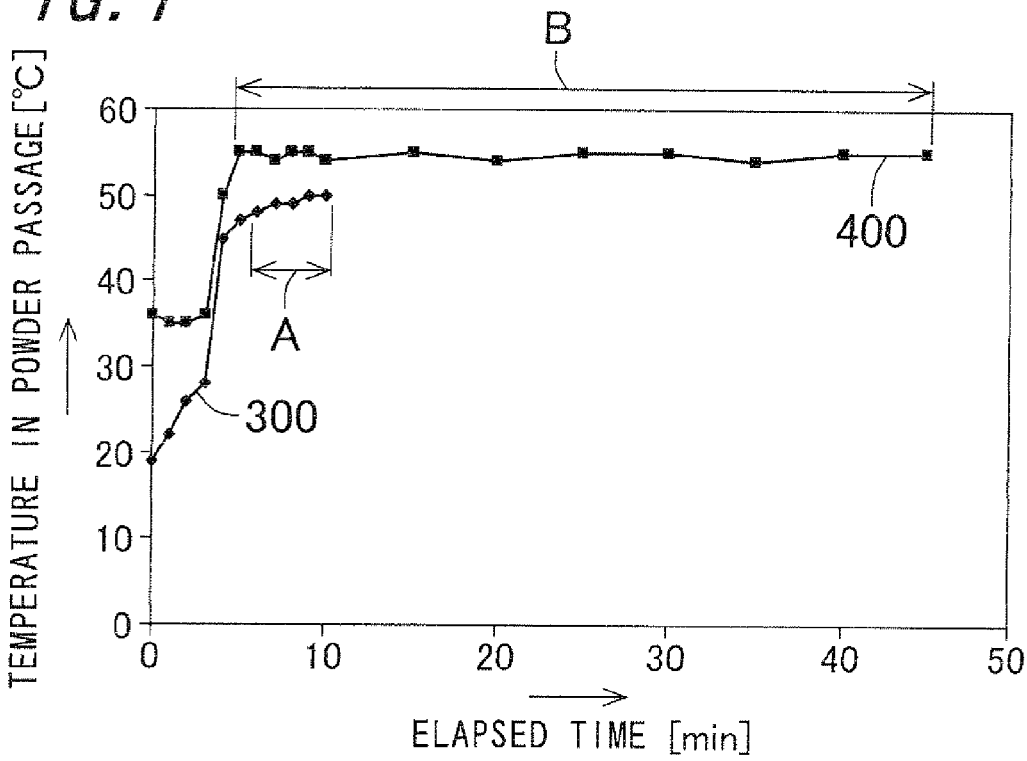
FIG. 7 is a graph showing a temperature transition in a powder passage.

FIG. 7 is a graph showing a temperature transition in the powder passage 202 from the time of starting each step in the stirring step S3 and the spraying step S5 of Example 1. A temperature transition at the stirring step S3 is indicated by a curve 300. A temperature transition at the spraying step S5 is indicated by a curve 400. The temperature in the powder passage 202 is regarded as a stirring stability temperature during the period A at the stirring step S3, and the temperature in the powder passage 202 is regarded as a spraying stability temperature during the period B at the spraying step S5. In the following Examples 2 to 10 and Comparative Examples 1 and 2, the temperature at the time of starting the steps, the stirring stability temperature and the spraying stability temperature are different respectively, however, each of temperature transitions thereof is almost same as the temperature transition in the powder passage 202 in Example 1.

<Collecting Step S6>

After stopping the rotary stirring section 204, a toner according to Example 1 was obtained from the powder collecting section 207.

Example 2

A toner according to Example 2 was obtained in the same manner as Example 1, except that an additive amount of the fine inorganic particle was set to 2 parts by weight.

Example 3

An toner according to Example 3 was obtained in the same manner as Example 1, except that the fine inorganic particle was set to 5 parts by weight of fine silica particles having a number average particle size of 40 nm whose surfaces were treated by hexamethyldisilazane (ENDS) (trade name: AEROSIL RX50, manufactured by NIPPON AEROSIL CO., LTD.)

Example 4

A toner according to Example 4 was obtained in the same manner as Example 1, except that the fine inorganic particle was set to 5 parts by weight of titanium oxide fine particles having a number average particle size of 40 nm whose surfaces were treated by i-butyltrimethoxysilane (BTMS) (trade name: STT30, manufactured by Titan Kogyo, Ltd.)

Example 5

A toner according to Example 5 was obtained in the same manner as Example 1, except that the fine inorganic particle was set to 5 parts by weight of metatitanic acid fine particles having a number average particle size of 40 nm whose surfaces were treated by i-butyltrimethoxysilane (BTMS) (trade name: STT550, manufactured by Titan Kogyo, Ltd.)

Example 6

A toner according to Example 6 was obtained in the same manner as Example 1, except that the fine inorganic particle was set to 0.1 part by weight of fine silica particles having a number average particle size of 12 nm whose surfaces were treated by hexamethyldisilazane (HMDS) (trade name: AEROSIL RX200, manufactured by NIPPON AEROSIL CO., LTD.) and to 2.5 parts by weight of titanic oxide fine particles having a number average particle size of 40 nm whose surfaces were treated by i-butyltrimethoxysilane (BTMS) (trade name: STT30, manufactured by Titan Kogyo, Ltd.)

Example 7

A toner according to Example 7 was obtained in the same manner as Example 1, except that the fine inorganic particle was set to 0.2 part by weight of fine silica particles having a number average particle size of 7 nm whose surfaces were treated by hexamethyldisilazane (HMDS) (trade name: AEROSIL RX300, manufactured by NIPPON AEROSIL CO., LTD.)

Example 8

A toner according to Example 8 was obtained in the same manner as Example 1, except that the fine inorganic particle was set to 10 parts by weight of fine silica particles having a number average particle size of 440 nm whose surfaces were treated by hexamethyldisilazane (ENDS) (trade name: AEROSIL RX50, manufactured by NIPPON AEROSIL CO., LTD.)

Example 9

A toner according to Example 9 was obtained in the same manner as Example 1, except that the fine inorganic particle was set to 5 parts by weight of fine silica particles having a number average particle size of 100 nm whose surfaces were treated by hexamethyldisilazane (ENDS) (trade name: X-24, manufactured by Shin-Etsu Silicones)

Example 10

A toner according to Example 10 was obtained in the same manner as Example 1, except that the fine inorganic particle was set to 0.2 part by weight of fine silica particles having a number average particle size of 12 nm whose surfaces were not treated (trade name: AEROSIL 200, manufactured by NIPPON AEROSIL CO., LTD.)

Comparative Example

A toner according to Comparative Example 1 was obtained in the same manner as Example 1, except that the fine inorganic particle did not adhere to the surface of the toner core particle.

Comparative Example 2

A toner according to Comparative Example 2 was obtained in the same manner as Example 1, except that a fine inorganic particle did not adhere to the surface of a toner core particle and ethanol spraying time was set for 30 minutes at the spraying step S5.

Table 1 collectively shows a fine inorganic particle, an ethanol spraying time and an additive ratio by weight as to Examples 1 to 10 and Comparative Examples 1 and 2.

TABLE 1

| | Fine inorganic particle | | | | | |
|---|---|---|---|---|---|---|
| | Composition | Number average particle size | Surface treatment | Additive amount | Spraying time [minute] | Additive ratio by weight [%] |
| Example 1 | Silica | 12 nm | HMDS | 0.2 part | 15 | 0.2 |
| Example 2 | Silica | 12 nm | HMDS | 2 parts | 15 | 2 |
| Example 3 | Silica | 40 nm | HMDS | 5 parts | 15 | 5 |
| Example 4 | Titanium oxide | 40 nm | BTMS | 5 parts | 15 | 5 |
| Example 5 | Metatitanic acid | 40 nm | BTMS | 5 parts | 15 | 5 |
| Example 6 | Silica | 12 nm | HMDS | 0.1 part | 15 | 2.6 |
| | Titanium oxide | 40 nm | BTMS | 2.5 parts | | |
| Example 7 | Silica | 7 nm | HMDS | 0.2 part | 15 | 0.2 |
| Example 8 | Silica | 40 nm | HMDS | 10 parts | 15 | 10 |
| Example 9 | Silica | 100 nm | HMDS | 5 parts | 15 | 5 |
| Example 10 | Silica | 12 nm | No treatment | 0.2 part | 15 | 0.2 |
| Comparative Example 1 | — | — | — | — | 15 | — |
| Comparative Example 2 | — | — | — | — | 30 | — |

[Evaluation]

As to Examples 1 to 10 and Comparative Examples 1 and 2, the evaluation was conducted for an adhering state, coating uniformity, a coating state and yields as follows.

<Adhering State>

As to Examples 1 to 10 and Comparative Examples 1 and 2, the adhering state of the fine resin particle to the surface of the toner core particle in the toner core particles to which the fine resin particles adhered which were collected right after finishing the stirring step S3, was examined. The toner core particle was sampled to be observed by using a scanning electron microscope (SEM) of 1000 times power, and was visually judged.

A state where fine resin particles are dispersed and adhered uniformly on the surfaces of toner core particles, without being aggregate, is able to be judged as good. Judgmental standards of the adhering state are as follows.

Good: There is no aggregate, being adhered uniformly to the surface of a toner core particle.

Not bad: Few aggregates are observed.

Poor: Many aggregates are observed and an adhering amount to the surface of a toner core particle is insufficient.

<Coating Uniformity>

The toners obtained in Examples 1 to 10 and Comparative Examples 1 and 2 were used for evaluating the coating uniformity which is the uniformity of thickness of a fine resin particle layer depending on presence/absence of toner aggregations after high-temperature preservation. A toner of 20 g was sealed in a plastic container, followed by leaving at 50° C. for 48 hours, thereafter the toner was taken out to check the presence of aggregations thereof visually and then was passed through a 230-mesh sieve. The weight of the toner remained on the sieve was measured, and the remaining amount as a rate of this weight to the total weight of the toner (20 g) was obtained to be evaluated by the following standards. The lower value of the remaining amount shows that the toner is not blocked and preservability is excellent, that is, the coating uniformity is superior.

Evaluation standards of the coating uniformity are as follows.

Good: Aggregations are not visually confirmed at all. The remaining amount is 1% or less.

Not bad: Aggregations are not visually confirmed. The remaining amount exceeds 1% and less than 3%.

Poor: A small amount of aggregations are visually confirmed. The remaining amount is 3% or more.

<Coating State>

The toner obtained by Examples 1 to 10 and Comparative Examples 1 and 2 was observed by using a SEM of 1000 times power, and a state of a fine resin particle layer on the toner surface was visually judged.

A state where there are no aggregations detaching from the surface of a toner core particle, and a fine resin particle without film formation and flatting is not present on the surface of a toner core particle is judged as good. Judgmental standards are as follows.

Good: Aggregations and unfixed fine resin particles are not found.

Not bad: No aggregations, however, unfixed fine resin particles are slightly present on the surfaces of the core particles.

Poor: Aggregations are present in a state of detaching from the surfaces of the core particles.

<Yield>

In Examples 1 to 10 and Comparative Examples 1 and 2, the yield of a toner was obtained as follows.

Yield [%]=Collected amount of toner [g])/(Total inputting amount of toner core particles and fine resin particles [g])×100

Excellent: Very favorable. The calculated toner yield is 95% or more.

Good: Favorable. The calculated toner yield is 90% or more and less than 95%.

Not bad: No problem with practical use. The calculated toner yield is 80% or more and less than 90%.

Poor: No good. The calculated toner yield is less than 80%.

TABLE 2

| | Adhering state | Coating uniformity | Coating state | Yield |
|---|---|---|---|---|
| Example 1 | Good | 0.3% (Good) | Good | 95% (Excellent) |
| Example 2 | Good | 0.0% (Good) | Good | 97% (Excellent) |
| Example 3 | Good | 0.3% (Good) | Good | 96% (Excellent) |
| Example 4 | Good | 0.5% (Good) | Good | 92% (Good) |
| Example 5 | Good | 0.2% (Good) | Good | 97% (Excellent) |
| Example 6 | Good | 0.4% (Good) | Good | 95% (Excellent) |
| Example 7 | Not bad | 1.2% (Not bad) | Not bad | 84% (Not bad) |
| Example 8 | Good | 0.2% (Good) | Not bad | 97% (Excellent) |
| Example 9 | Not bad | 2.7% (Not bad) | Not bad | 86% (Not bad) |
| Example 10 | Not bad | 1.9% (Not bad) | Not bad | 92% (Good) |
| Comparative Example 1 | Not bad | 7.9% (Poor) | Poor | 82% (Not bad) |
| Comparative Example 2 | Not bad | 0.5% (Good) | Good | 91% (Good) |

<Consideration>

As shown in Table 2, it is found that when the fine inorganic particles adhere to the surface of the toner core particle, it is possible to form a good fine resin particle layer even with a small spraying amount of ethanol. On the other hand, it is found that when a fine inorganic particles do not adhere to the surface of the toner core particle, a state of a fine resin particle layer that is formed with a small spraying amount of ethanol gets worse. Additionally, it is found that it is possible to form a good fine resin particle layer with an increased spraying amount of ethanol even when the fine inorganic particle does not adhere to the surface of the toner core particle, however, the yield thereof gets lower compared to a case where the fine inorganic particles applied with surface treatment adhere to the surface of the toner core particle.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A toner manufacturing method of manufacturing a toner using a toner manufacturing apparatus comprising a powder passage in which a powder is flowable, a spraying section for spraying a predetermined substance in the powder passage and a rotary stirring section, provided in the powder passage, and stirring particles in the powder passage to apply impact force to the particles so that the particles are fluidized in the powder passage, the toner manufacturing method comprising:

a stirring step of fluidizing toner core particles with fine inorganic particles adhering to the surfaces thereof and fine resin particles in the powder passage as the powder by the rotary stirring section; and a spraying step of spraying a volatile liquid which softens the fine resin particles as the predetermined substance by the spraying section.

2. The toner manufacturing method of claim 1, wherein the fine inorganic particles have a number average particle size of 12 nm or more and 40 nm or less.

3. The toner manufacturing method of claim 1, wherein the fine resin particle is a fine resin particle in which fine inorganic particles having a number average particle size of 12 nm or more and 40 nm or less adhere to the surface thereof.

4. The toner manufacturing method of claim 1, wherein the toner core particles are toner core particles in which the fine inorganic particles adhere to the surfaces of the toner core particles so that an additive ratio by weight which is percentage of a total weight of the fine inorganic particles adhering to the surface of the toner core particle to the weight of the toner core particle is 0.2% or more and 5% or less.

5. The toner manufacturing method of claim 1, wherein the fine inorganic particle contains at least one of silica, titanium oxide and metatitanic acid.

6. The toner manufacturing method of claim 1, wherein the fine inorganic particle contains at least one of silica whose surface is treated with hexamethyldisilazane, and titanium oxide and metatitanic acid whose surfaces are treated with trimethylchlorosilane.

7. A toner obtained by the toner manufacturing method of claim 1.

8. A one-component developer comprising the toner of claim 7.

9. A developing device that performs a development by using the one-component developer of claim 8.

10. An image forming apparatus comprising the developing device of claim 9.

11. A two-component developer including the toner of claim 7 and a carrier.

12. A developing device that performs a development by using the two-component developer of claim 11.

13. An image forming apparatus comprising the developing device of claim 12.

* * * * *